US007004565B2

(12) United States Patent
Suzuki et al.

(10) Patent No.: US 7,004,565 B2
(45) Date of Patent: Feb. 28, 2006

(54) INK-JET HEAD AND INK-JET PRINTER HAVING THE INK-JET HEAD

(75) Inventors: Akihiro Suzuki, Nishio (JP); Atsushi Hirota, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/367,816

(22) Filed: Feb. 19, 2003

(65) Prior Publication Data

US 2003/0156157 A1 Aug. 21, 2003

(30) Foreign Application Priority Data

Feb. 18, 2002 (JP) ..... 2002-040559
Feb. 20, 2002 (JP) ..... 2002-043592

(51) Int. Cl.
*B41J 2/14* (2006.01)
*B41J 2/16* (2006.01)

(52) U.S. Cl. ..... 347/50; 347/71

(58) Field of Classification Search ..... 347/20, 347/47, 50, 68, 71, 72, 87
See application file for complete search history.

(56) References Cited

U.S. PATENT DOCUMENTS 5,402,159 A 3/1995 Takahashi et al. ..... 347/9
5,548,894 A * 8/1996 Muto ..... 29/890.1
5,581,288 A 12/1996 Shimizu et al. ..... 347/87
6,027,208 A 2/2000 Amano ..... 347/70
6,109,736 A * 8/2000 Miyata et al. ..... 347/68
6,431,691 B1 8/2002 Tanikawa et al. ..... 347/70
6,550,897 B1 4/2003 Nakamura et al. ..... 347/68
6,652,062 B1 * 11/2003 Umeyama et al. ..... 347/20
2002/0012029 A1 1/2002 Miyata ..... 347/68
2003/0156166 A1 8/2003 Sakaida ..... 347/68
2004/0041885 A1 3/2004 Hirota ..... 347/72

FOREIGN PATENT DOCUMENTS

EP 0 863 007 A2 9/1998
JP 4-341852 11/1992
JP 2002-19102 1/2002
WO WO 01/49493 A2 7/2001

* cited by examiner

*Primary Examiner*—Thinh Nguyen
(74) *Attorney, Agent, or Firm*—Oliff & Berridge, PLC

(57) ABSTRACT

An ink-jet head according to the invention includes a passage unit in which a plurality of pressure chambers, each having one end connected with a nozzle for ejecting ink and the other end to be connected with an ink supply source, are arranged along a plane neighboring each other, and an actuator unit arranged at a surface of the passage unit for changing the volume of each of the pressure chambers. Further, the ink-jet head includes a flexible printed circuit having signal lines electrically connected to the actuator unit, each signal line supplying a drive signal for changing the volume of the pressure chamber, a support member for supporting the head unit, and a seal member arranged between support member and the passage unit. Further, the flexible printed circuit is fixed to the support member and the passage unit by the seal member.

19 Claims, 15 Drawing Sheets

1

73
75
50
30a
73a
85
21
3
30
4

201

73
75
50
30a
73a
85
221
3
30
4

INK-JET HEAD AND INK-JET PRINTER HAVING THE INK-JET HEAD

BACKGROUND OF THE INVENTION

Field of Invention

The invention relates to an ink-jet head for printing by ejecting ink onto a print medium, and to an ink-jet printer having the ink-jet head.

In an ink-jet printer, an ink-jet head distributes ink which is supplied from an ink tank to a manifold channel, to pressure chambers. The ink-jet head selectively applies pressure to each pressure chamber to eject ink through a nozzle. As a means for selectively applying pressure to the pressure chambers, an actuator unit may be used in which ceramic piezoelectric sheets are laminated.

As an example, an ink-jet head as described above has an actuator unit with continuous flat piezoelectric sheets extending over a plurality of pressure chambers. According to the above-described ink-jet head, a common electrode, common to many pressure chambers and being kept at the ground potential, and individual electrodes, i.e., driving electrodes disposed at positions corresponding to the respective pressure chambers, are arranged among a plurality of piezoelectric sheets which are laminated of the actuator unit. Further, surface electrodes, which are respectively connected to the common electrode and the individual electrodes, are formed at an upper face of the piezoelectric sheet of a topmost layer. Further, a flexible printed circuit used for electrically connecting the surface electrodes and a power source portion is disposed to the upper face of the topmost layer of the piezoelectric sheet. By applying voltage between the common electrode and the individual electrodes by the power source portion via the flexible printed circuit and the surface electrodes, strain is generated at the piezoelectric sheets in the actuator unit and ink is ejected. Generally, the ink-jet printer having such an ink-jet head prints while an image recording medium, such as an image recording medium sheet, is being transferred from a front end portion thereof successively to a position opposed to the head.

When a force of peeling off the flexible printed circuit on the piezoelectric sheet formed with the surface electrodes is exerted from outside and the flexible printed circuit is peeled off from above the piezoelectric sheet, the electric connection between the surface electrodes and the power source portion is cut. As a result, voltage cannot be applied between the common electrode and the individual electrode, and therefore, ink cannot be ejected from the ink-jet head. Further, in such a printer, when the front end portion of the image recording medium advances to the position opposed to the head, the front end portion of the image recording medium may collide with a side face of the head and thus, cannot be transferred properly. When this occurs, the image recording medium may jam the printer or may cause failure of the printer head.

SUMMARY OF THE INVENTION

One objective of the invention to provide an ink-jet head having a reliable electric connection between an actuator unit and a power source portion, and an ink-jet printer including the same.

Other objective of the invention to provide an ink-jet head that prevents a front end portion of an image recording medium from colliding with a side face thereof, and an ink-jet printer including the same.

According to a first aspect of the invention, there is provided an ink-jet head comprising a head unit including a passage unit in which a plurality of pressure chambers are arranged along a plane to neighbor each other, each chamber having one end coupled to or connected with a nozzle for ejecting ink and the other end to be coupled to or connected with an ink supply source. The ink-jet head further comprises an actuator unit arranged at a surface of the passage unit for changing the volume of each of the pressure chambers; signal lines electrically connected to the actuator unit, each signal line supplying a drive signal for changing the volume of each of the pressure chambers; and a support member for supporting the head unit, wherein the signal lines are interposed between the support member and either one of the passage unit and the actuator unit.

Accordingly, the signal lines electrically connected to the actuator unit are interposed between the support member and either one of the passage unit or the actuator unit. Therefore, even when a force for peeling off the signal lines from the actuator unit is exerted from outside, a large force is prevented from directly exerting onto a portion connecting the actuator unit and the signal lines. Therefore, the signal lines are difficult to peel off from the actuator unit. Thus, the electric connection between the actuator unit and the power source portion can be reliably maintained.

According to a second aspect of the invention, there is provided an ink-jet head comprising a head unit that includes a passage unit having a plurality of pressure chambers arranged along a plane adjacent to or neighboring each other, each pressure chamber having one end connected with a nozzle for ejecting ink and the other end to be connected with an ink supply source for supplying ink. The ink-jet head further comprises an actuator unit arranged at a surface of the passage unit for changing the volume of each of the pressure chambers, signal lines electrically connected to the actuator unit, each single line supplying a drive signal for changing the volume of each of the pressure chambers, a support member for supporting the head unit, and a seal member arranged between the support member and either one of the passage unit and the actuator unit. The signal lines are attached or fixed to the support member and either one of the passage unit and the actuator unit by the seal member.

Accordingly, the signal lines electrically connected to the actuator unit are fixed to the support member and either one of the passage unit and the actuator unit by the seal member. Therefore, even when a force for peeling off the signal line from the actuator unit is exerted from outside, the large force is prevented from directly exerting onto the portion connecting the actuator unit and the signal line. Therefore, the signal lines are difficult to peel off from the actuator unit. Thus, the electric connection between the actuator unit and the power source portion can be reliably maintained. Further, ink can be prevented from entering or intruding onto the portion connecting the actuator and the signal lines. Therefore, electric shortcircuit of the portion connecting both members can be prevented.

According to a third aspect of the invention, there is provided an ink-jet head comprising a head unit having a passage unit in which a plurality of pressure chambers are arranged along a plane neighboring each other, each chamber having one end connected with a nozzle for ejecting ink and the other end to be connected with an ink supply source for supplying ink, the passage unit including a plurality of laminated plates. The ink-jet head further comprises an actuator unit for changing the volume of each of the pressure chambers, the actuator unit arranged at a surface of the passage unit to be remote from an end portion of the passage unit. The ink-jet head further comprises a flexible cable electrically connected to the actuator unit and formed with signal lines as a conductive pattern, each signal line supplying a drive signal for changing the volume of the pressure chamber; a support member for supporting the head unit, the support member having the ink supply member and a holder for fixing the ink supply member; and a seal member arranged between the holder and a portion at the vicinity of an end portion of the passage unit, wherein the flexible cable is fixed to the portion at the vicinity of the end portion of the passage unit and the holder by the seal member.

Accordingly, the flexible cable formed with the signal lines electrically connected to the actuator unit are fixed to the portion at the vicinity of the end portion of the passage unit and the holder constituting a portion of the support member by the seal member. Therefore, even when a force of peeling off the flexible cable from the actuator unit is exerted from outside, the large force is prevented from directly exerting onto the portion connecting the actuator unit and the flexible cable. Therefore, the flexible cable is difficult to peel off from the actuator unit and thus, the electric connection between the actuator unit and the power source portion can be reliably maintained. Further, the holder constituting the portion of the support member can reduce stresses applied to the portion of connecting the actuator and flexible cable (for peeling off the both members) by bending the whole span of the head. Further, ink can be prevented from entering the portion connecting the actuator unit and the flexible cable. Therefore, electric shortcircuit of the portion connecting the both members can be prevented. The above-described results can also be achieved by using an elongated head laminated with a plurality of actuator unit in a laminated type passage unit.

According to a fourth aspect of the invention, there is provided an ink-jet head comprising a head unit having a passage unit in which a plurality of pressure chambers are arranged along a plane to neighbor each other, each chamber having one end connected with a nozzle for ejecting ink and the other end to be connected with an ink supply source for supplying ink, the passage unit including a plurality of laminated plates. The ink-jet head further comprises an actuator unit arranged at a surface of the passage unit for changing the volume of each of the pressure chambers, and a holder for supporting the passage unit, the holder being arranged over a face of the actuator unit opposite to the surface. The vicinity of an end portion of a nozzle plate having the nozzle along the longitudinal direction thereof is bent closer to the holder.

Accordingly, the vicinity of the end portion along the longitudinal direction of the nozzle plate is bent to the side of the holder and therefore, even when a front end portion of a print medium collides with the portion, the front end is configured to advance to a position opposed to the head while being guided. This prevents the front end portion of the image recording medium from colliding with the side face of the head (passage unit) such that jamming does not occur. Further, in order to prevent the front end portion of the image recording medium from colliding with the side face of the head, the nozzle plate is used and therefore, it is not necessary to prepare other member. This configuration is achieved with low cost and the size of the head is minimally increased.

According to a fifth aspect of the invention, there is provided an ink-jet printer including an ink-jet head comprising a head unit having a passage unit in which a plurality of pressure chambers are arranged along a plane neighboring each other, each chamber having one end connected with a nozzle for ejecting ink and the other end to be connected with an ink supply source for supplying ink; an actuator unit arranged at a surface of the passage unit for changing the volume of each of the pressure chambers; signal lines electrically connected to the actuator unit, each signal line supplying a drive signal for changing the volume of each of pressure chambers; and a support member for supporting the head unit, wherein the signal lines are interposed between the support member and either one of the passage unit and the actuator unit.

According to a sixth aspect of the invention, there is provided an ink-jet printer including an ink-jet head comprising a head unit having a passage unit in which a plurality of pressure chambers are arranged along a plane to neighbor each other, each chamber having one end connected with a nozzle for ejecting ink and the other end to be connected with an ink supply source for supplying ink; an actuator unit arranged at a surface of the passage unit for changing the volume of each of the pressure chambers; signal lines electrically connected to the actuator unit, each signal line supplying a drive signal for changing the volume of the pressure chambers; a support member for supporting the head unit; and a seal member arranged between the support member and either one of the passage unit and the actuator unit, wherein the signal lines are fixed to the support member and either one of the passage unit and the actuator unit by the seal member.

Accordingly, even when a force for peeling off the signal lines from the actuator unit are exerted on the ink-jet head from outside, the signal lines are difficult to peel off from the actuator unit and therefore, the electric connection of the ink-jet printer can be reliably maintained.

According to a seventh aspect of the invention, there is provided an ink-jet printer including an ink-jet head comprising a head unit having a passage unit in which a plurality of pressure chambers are arranged along a plane neighboring each other, each chamber having one end connected with a nozzle for ejecting ink and the other end to be connected with an ink supply source for supplying ink, the passage unit including a plurality of laminated plates; an actuator unit arranged at a surface of the passage unit for changing the volume of each of the pressure chambers; a holder for supporting the passage unit, the holder arranged over a face of the actuator unit opposite to the surface, wherein the vicinity of an end portion of a nozzle plate including the nozzle along a longitudinal direction thereof is bent closer to the holder.

Accordingly, this configuration prevents the front end portion of the image recording medium from colliding with the side face of the head (passage unit), which can cause jamming of the image recording medium or the failure of the head. Further, because it is not necessary to provide another member for preventing the front end portion of the image recording medium from colliding with the side face of the head, cost can be kept low and the size of head minimally increased.

BRIEF DESCRIPTION OF THE DRAWINGS

Various exemplary embodiments of the invention will be described in detail with reference to the following figures, in which.

DETAILED DESCRIPTION OF PREFERRED EMBODIMENTS

Figure 1:
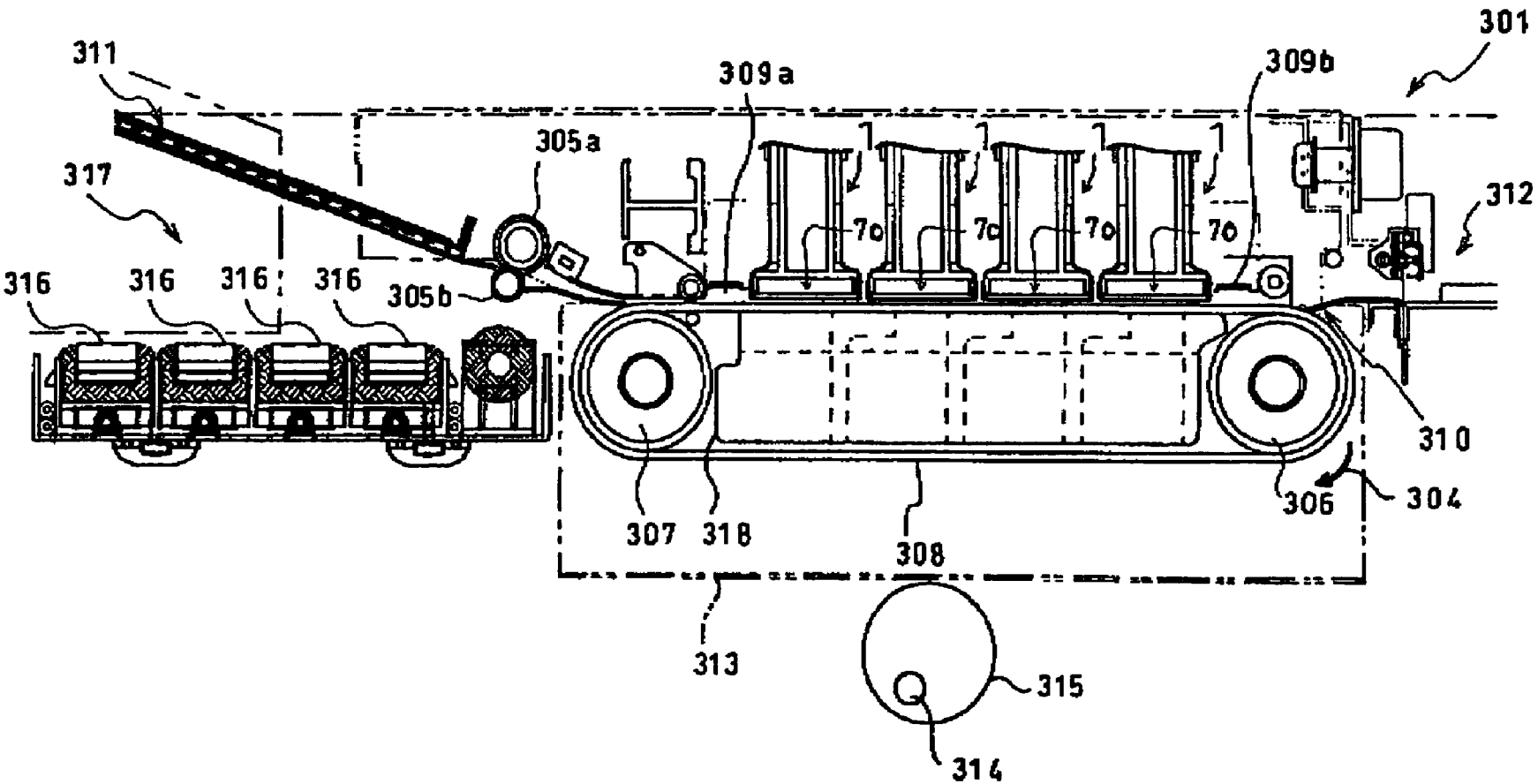
FIG. 1 is a general view of an ink-jet printer including an ink-jet heads according to an embodiment of the invention.

FIG. 1 is a general view of an ink-jet printer including ink-jet heads according to an embodiment of the invention. The ink-jet printer 301 illustrated in FIG. 1 is a color ink-jet printer having four ink-jet heads 1. In this printer 301, an image recording medium feed unit 311 and an image recording medium discharge unit 312 are disposed in left and right portions of the printer 301 in FIG. 1, respectively.

In the printer 301, an image recording medium transfer path is provided extending from the image recording medium feed unit 311 to the image recording medium discharge unit 312. A pair of feed rollers 305*a* and 305*b* are disposed immediately downstream of the image recording medium feed unit 311 for pinching and advancing an image record medium, such as, for example a sheet of paper. In various exemplary embodiments, the image recording medium includes, for example, a sheet of paper, card stock, photo paper, a transparency, or the like.

The image recording medium is transferred by the pair of feed rollers 305*a* and 305*b* from the left to the right in FIG. 1. Two belt rollers 306 and 307 and an endless transfer belt 308 are disposed in the middle of the image recording medium transfer path. The transfer belt 308 is wound on, and extends between, the belt rollers 306 and 307. The outer face, i.e., the transfer face, of the transfer belt 308 has been treated with silicone. Thus, an image recording medium fed through the pair of feed rollers 305*a*, 305*b* can be held on the transfer face of the transfer belt 308 by the adhesion of the silicone treated face. In this state, the image recording medium is transferred downstream (rightward) by driving one belt roller 306 to rotate clockwise in FIG. 1 (the direction indicated by an arrow 304).

Pressing members 309*a* and 309*b* are disposed at positions for feeding an image recording medium onto the belt roller 306 and extracting the image recording medium from the belt roller 306, respectively. Either of the pressing members 309*a* and 309*b* used is for pressing the image recording medium onto the transfer face of the transfer belt 308 so as to prevent the image recording medium from separating from the transfer face of the transfer belt 308. Thus, the image recording medium securely adheres to the transfer face.

A peeling device 310 is provided immediately downstream of the transfer belt 308 along the image recording medium transfer path. The peeling device 310 peels off the image recording medium, which has adhered to the transfer face of the transfer belt 308, from the transfer face to transport the image recording medium toward the rightward paper discharge unit 312.

Each of the four ink-jet heads 1 has, at its lower end, a head unit 70. Each head unit 70 has a rectangular section. The head units 70 are arranged close to each other with the longitudinal axis of each head unit 70 being perpendicular to the image recording medium transfer direction (perpendicular to FIG. 1). That is, printer 301 is a line type printer. The bottom of each of the four head units 70 faces the image recording medium transfer path. In the bottom of each head unit 70, a number of nozzles are provided each having a small-diameter ink ejection port. The four head units 70 eject ink of magenta, yellow, cyan, and black, respectively. However, various other embodiments of the invention are not limited by the above described colors or order.

The head units 70 are disposed such that a narrow clearance must be formed between the lower face of each head unit 70 and the transfer face of the transfer belt 308. The paper transfer path is formed within the narrow clearance. In this embodiment, while an image recording medium, which is being transferred by the transfer belt 308, passes immediately below the four head units 70 in order, the inks are ejected through the corresponding nozzles toward the upper face, i.e., the print face, of the image recording medium to form a desired color image on the image recording medium.

The ink-jet printer 301 is provided with a maintenance unit 317 for automatically carrying out maintenance of the ink-jet heads 1. The maintenance unit 317 includes four caps 316 for covering the lower faces of the four head units 70, and a purge system (not shown).

The maintenance unit 317 is at a position immediately below the image recording medium feed unit 311 (withdrawal position) while the ink-jet printer 301 operates to print. When a predetermined condition is satisfied after finishing the printing operation (for example, when a state in which no printing operation is performed continues for a predetermined time period or when the printer 301 is powered off), the maintenance unit 317 moves to a position immediately below the four head units 70 (cap position), where the maintenance unit 317 covers the lower faces of the head units 70 with the respective caps 316 to prevent ink in the nozzles of the head units 70 from becoming dry.

The belt rollers 306 and 307 and the transfer belt 308 are supported by a chassis 313. The chassis 313 is set on a cylindrical member 315 disposed under the chassis 313. The cylindrical member 315 is rotatable around a shaft 314 provided at a position deviating from the center of the cylindrical member 315. Thus, by rotating the shaft 314, the level of the uppermost portion of the cylindrical member 315 can be changed to move the chassis 313 up or down accordingly. When the maintenance unit 317 is moved from the withdrawal position to the cap position, the cylindrical member 315 will have been rotated at a predetermined angle in advance so as to move the transfer belt 308 and the belt rollers 306 and 307 down by an appropriate distance from the position illustrated in FIG. 1, thus creating a space for the movement of the maintenance unit 317.

In the region surrounded by the transfer belt 308, a nearly rectangular guide 318 (having its width substantially equal to that of the transfer belt 308) is disposed at a position opposite to the ink-jet heads 1. The guide 318 is in contact with the lower face of the upper part of the transfer belt 308 to support the upper part of the transfer belt 308 from the inside.

Figure 2:
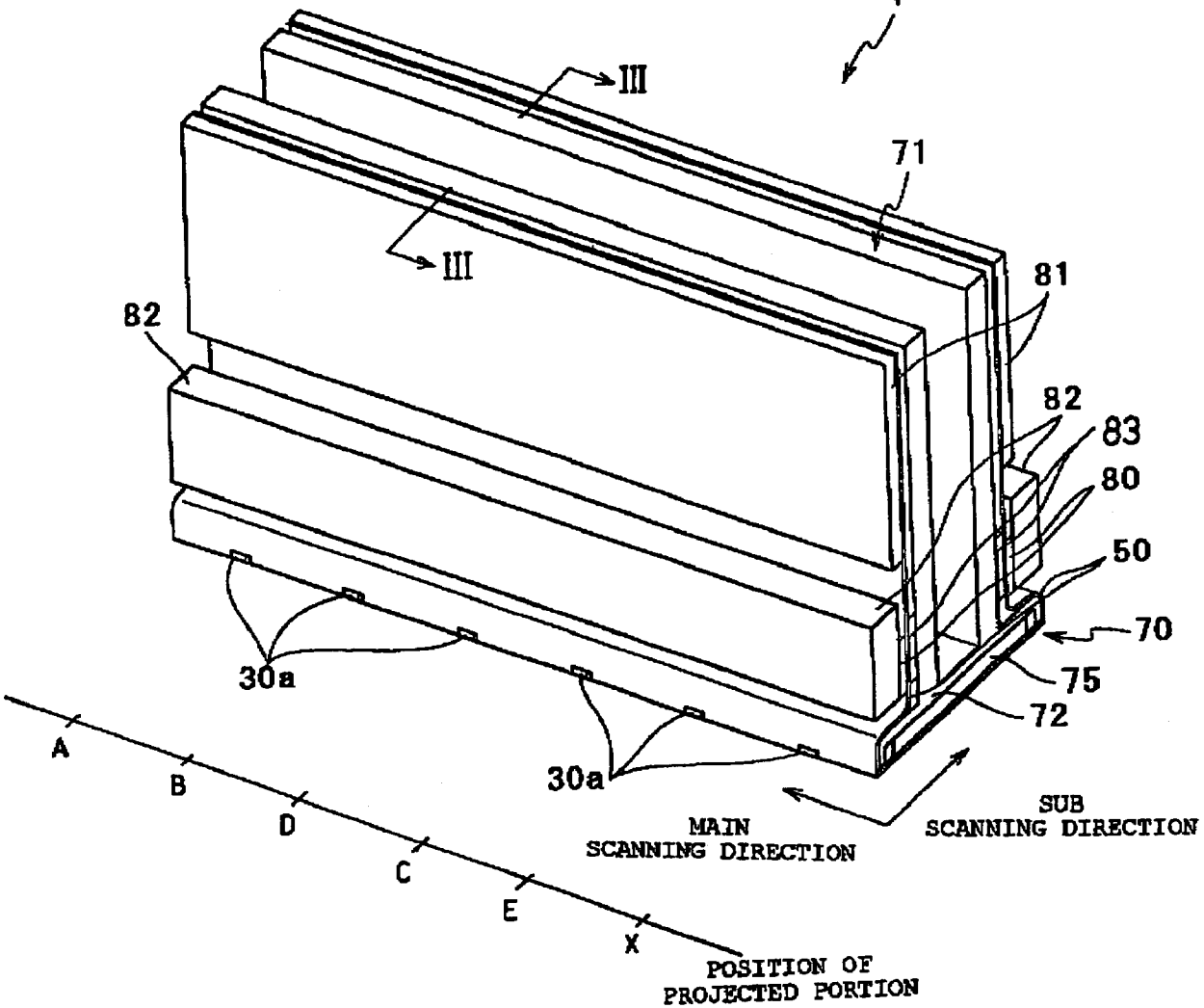
FIG. 2 is a perspective view of the ink-jet head according to the embodiment of the invention.
Figure 3:
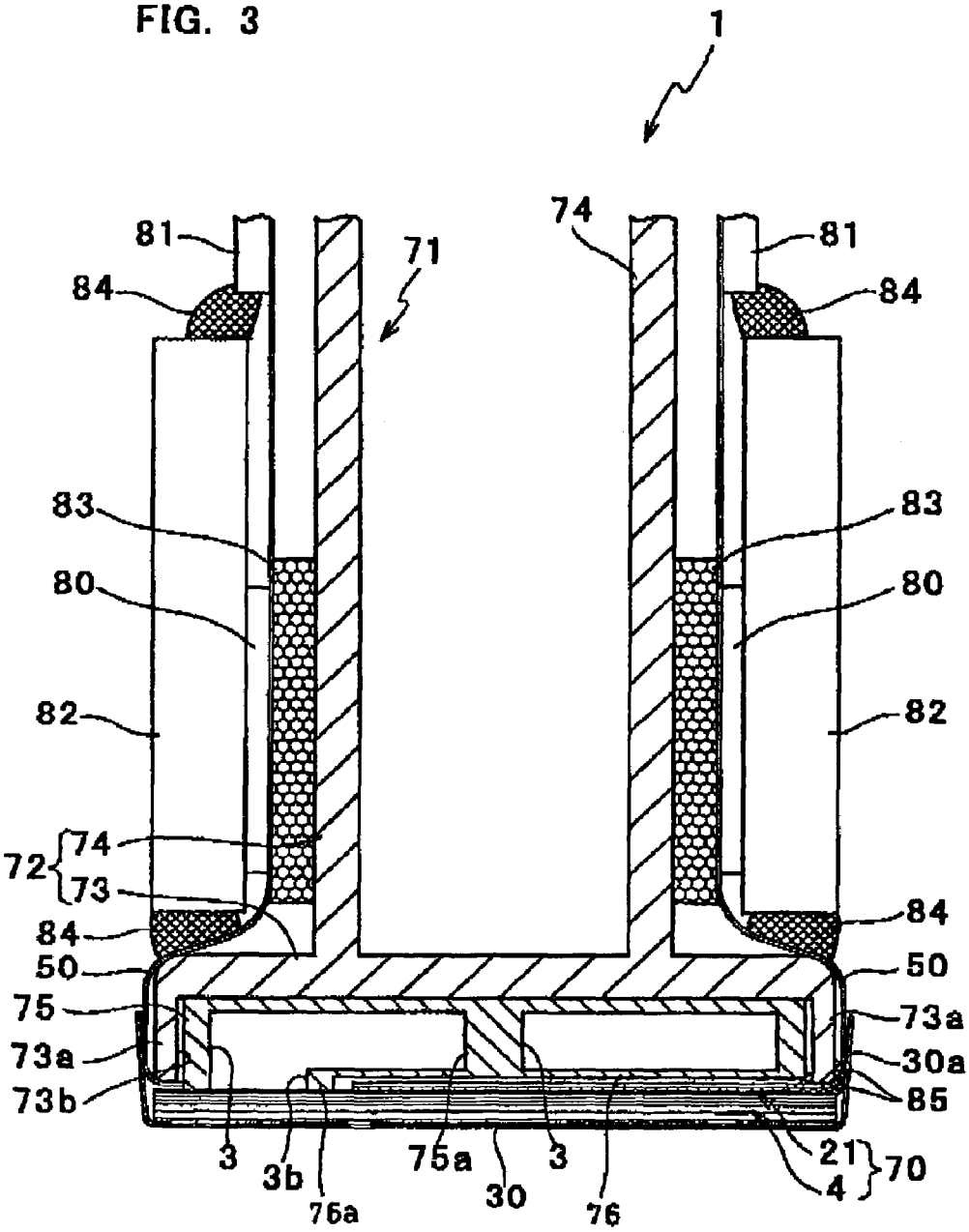
FIG. 3 is a sectional view taken along a line III—III of FIG. 2.

Referring to FIG. 2 and FIG. 3, the construction of each the ink-jet heads 1 according to this embodiment will be described in more detail. The ink-jet head 1 according to this embodiment includes head unit 70 having a nearly rectangular shape in a plan view with its longest side extending in the main scanning direction, a support member 71 for supporting the head unit 70, driver ICs 80 for supplying driving signals to individual electrodes 35*a* (see FIG. 6 and FIG. 10), substrates 81 and heat sinks 82.

The head unit 70 is a member having a nearly rectangular shape in a plan view including a passage unit 4 and a plurality of actuator units 21 bonded to the upper face of the passage unit 4 (shown in FIG. 4 and FIG. 7) for ejecting ink onto the image recording medium. Further, a detailed constitution of the head unit 70 will be described later.

Referring to FIG. 3, the support member 71 includes a base block 75 partially bonded to the upper face of the head unit 70 to support the head unit 70, and a holder 72 bonded to the upper face of the base block 75 to support the base block 75. The base block 75 functions as an ink supply source or an ink supply member for supplying ink to the head unit 70. The holder 72 includes a holder main body 73 disposed near the head unit 70, and a pair of holder support portions 74 each extending on the opposite side of the holder main body 73 from the head unit 70.

The holder main body 73 is a member having a flat shape, which is nearly the same as that of the head unit 70, and provided with a pair of projected portions 73*a* extended in a longitudinal direction and formed to project downwardly at both end portions in a direction of moving sheet relative to the ink-jet head 1 and a direction perpendicular to the main scanning direction. In this embodiment, either projected portions 73*a* is through the length of the holder main body 73. As a result, in the lower portion of the holder main body 73, a nearly rectangular groove 73*b* is defined by the pair of projected portions 73*a*. Further, each holder support portion 74 is as flat member. The holder support portions 74 extend along the longitudinal direction of the holder main body 73 and are disposed substantially parallel to each other at a predetermined interval.

The base block 75 is a nearly rectangular member having substantially the same length of the head unit 70, and is provided with a passage used to supply ink to the head unit 70. Further, the base block 75 is disposed to be received in the groove portion 73*b* of the holder main body 73. The upper surface of the base block 75 is bonded to the bottom of the groove portion 73*b* of the holder main body 73 with an adhesive. Further, the thickness of the base block 75 is slightly larger than the depth of the groove portion 73*b* of the holder main body 73. As a result, the lower end of the base block 75 protrudes downward beyond the groove portion 73*b* of the holder main body 73.

Within the base block 75, as a passage for ink to be supplied to the head unit 70, two ink reservoirs 3 are formed as a nearly rectangular space (hollow region) extending along the longitudinal direction of the base block 75. The two ink reservoirs 3 are provided to be spaced apart from each other at a predetermined interval therebetween and substantially in parallel with each other along the longitudinal direction of the base block 75. That is, the two ink reservoirs 3 are formed by dividing the nearly rectangular space at the inside of the base block 75 into two by a partition wall 75*a* arranged near a center axis position of the base block 75 along the longitudinal direction. Further, a lower face 76 of the base block 75 is formed with an opening 3*b* at a position in correspondence with one of the ink reservoirs 3 (left side one in FIG. 3).

In this exemplary embodiment, the partition wall 75*a* may be disposed along the longitudinal direction to divide completely the rectangular space into two, or may be partially disposed along the longitudinal direction such that the ink reservoirs 3 formed on both sides of the partition wall 75*a* communicate with each other. Alternatively, the partition wall 75*a* may be disposed to extend in a sub scanning direction at inside of the base block 75, unless the opening 3*b* operated as an ink supply port is not hindered from being installed to open to supply ink to the head unit 70. In this case, the partition wall 75*a* may be disposed such that the ink reservoirs 3 formed by the partition wall 75*a* are partitioned thereby or the ink reservoirs 3 may be disposed to communicate with each other. Further, a plurality of the partition walls 75*a* may be disposed. In any configuration, the base block 75 having the space inside is operated as a kind of rigid member for forming the ink-jet head 1 by the partition wall 75*a* disposed inside. Thus, the base block 75 can be prevented from being bent by external forces that are produced even when the ink-jet head 1 is long.

In the lower face 76 of the base block 75, the vicinity of each opening 3*b* protrudes downward from the surrounding portion. The base block 75 is in contact with a passage unit 4 (see FIG. 3) of the head unit 70 at the only vicinity portion 76*a* of each opening 3*b* of the lower face 76. Thus, the region of the lower face 76 of the base block 75 other than the vicinity portion 76*a* of each opening 3*b* is distant from the head unit 70. Actuator units 21 are disposed within the distance.

According to this embodiment, the base block 75 included in the support member 71 is provided with a section substantially in a rectangular shape and a central portion is formed by a hollow structure (a structure having a space elongated in the longitudinal direction). The base block 75 made of metal material such as stainless steel functions as a light structure for reinforcing the support member 71 (ink-jet head 1). Further, the inside of the base block 75 is provided with the partition wall 75*a* for dividing the space formed inside into two along the longitudinal direction. Therefore, the strength of the support member 71 is increased by providing the partition wall 75*a* inside of the base block 75.

The driver IC 80 is attached at side faces on outer sides in the sub scanning directions of vicinities of route portions of the pair of holder support portions 74 of the holder 72 via elastic members 83 in a flat plate shape formed by sponge or the like. A flexible printed circuit (FPC) 50, used as an electricity feeding member, is connected to the driver IC 80. FPC 50 is disposed between the elastic member 83 and the driver IC 80. Further, a heat sink 82 is disposed on an outer side of the driver IC 80 to be in close contact with an outer side surface thereof. The heat sink 82 is a member having nearly rectangular shape for radiating heat generated at the driver IC 80. The elastic member 83 presses the heat generating driver IC 80 into the heat sink 82 to allow it to irradiate heat via FPC 50, thereby achieving excellent heat radiation results.

Further, the substrate 81 is disposed outside the FPC 50 above the driver IC 80 and the heat sink 82. The FPC 50 connected to the driver IC 80 is bonded to and electrically connected to the corresponding substrate 81 and the head unit 70 by soldering. The vicinity of the upper end portion of the heat sink 82 is bonded to the substrate 81 with a seal member 84. Also, the vicinity of the lower end portion of the heat sink 82 is bonded to the FPC 50 with a seal member 84.

Figure 4:
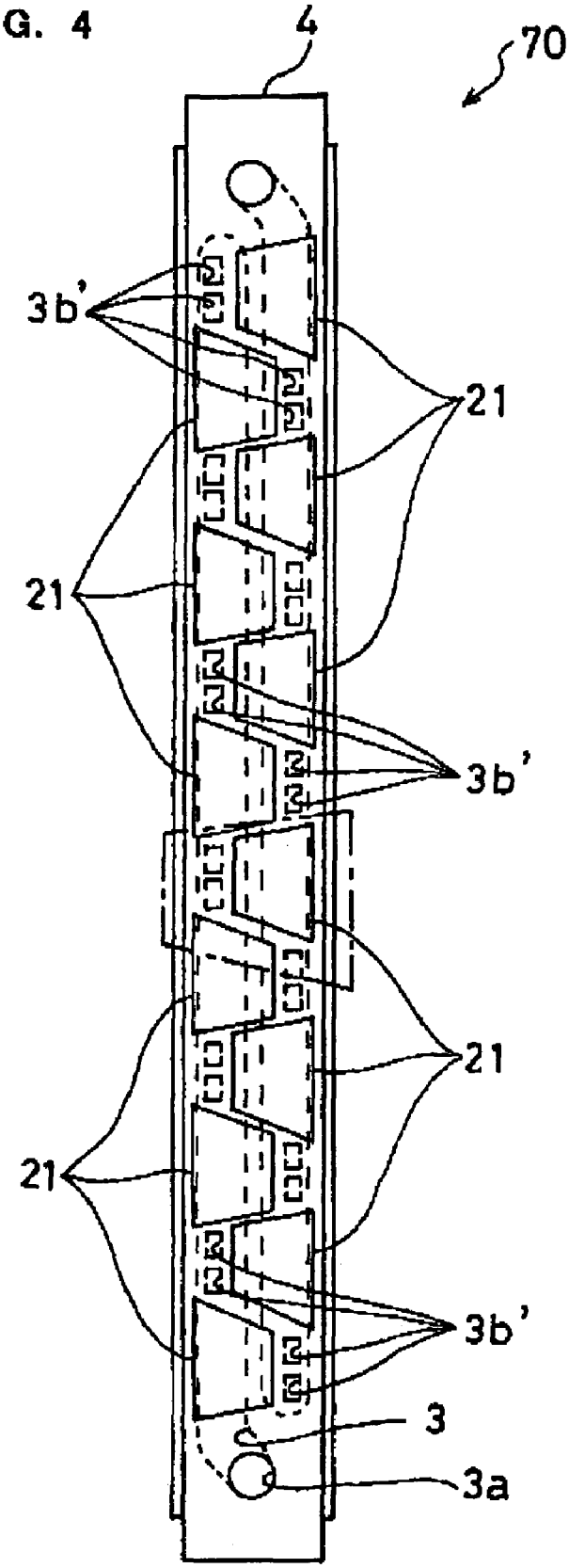
FIG. 4 is a plan view of a head unit included in the ink-jet head illustrated in FIG. 2.

FIG. 4 is a plan view of a head unit included in the ink-jet head illustrated in FIG. 2. As shown in FIG. 4, the head unit 70 includes a passage unit 4 having a large number of pressure chambers 10 and a large number of ink ejection ports 8 (shown in FIG. 5 through FIG. 7), as described later. Trapezoidal actuator units 21, arranged in two lines in a crisscross manner, are bonded onto the upper face of the passage unit 4. Further, FIG. 4 shows the head unit 70 from a side of the support member 71. Each actuator unit 21 is disposed such that its parallel opposed sides (upper and lower sides) extend along the longitudinal direction of the passage unit 4. The oblique sides of each neighboring actuator units 21 overlap each other in the lateral direction of the passage unit 4. The actuator unit 21 is disposed between the passage unit 4 and the base block 75, however, in FIG. 4, the actuator unit 21 is indicated by bold lines for ease of explanation.

The lower face of the passage unit 4 corresponding to the bonded region of each actuator unit 4 is configured into an ink ejection region. A large number of ink ejection ports 8 are arranged in a matrix in the surface of each ink ejection region. An ink reservoir 3 is formed along the longitudinal direction of the base block 75 in the base block 75 disposed above the passage unit 4. The ink reservoir 3 communicates with an ink tank (not shown) through an opening 3*a* provided at the upper face of the base block 75 (side of holder main body 73) so that the ink reservoir 3 is always filled up with ink. In the ink reservoir 3, as mentioned above, pairs of openings 3*b* are provided in regions where no actuator unit 21 is present, so as to be arranged in a crisscross manner along the longitudinal direction of the ink reservoir 3.

Figure 5:
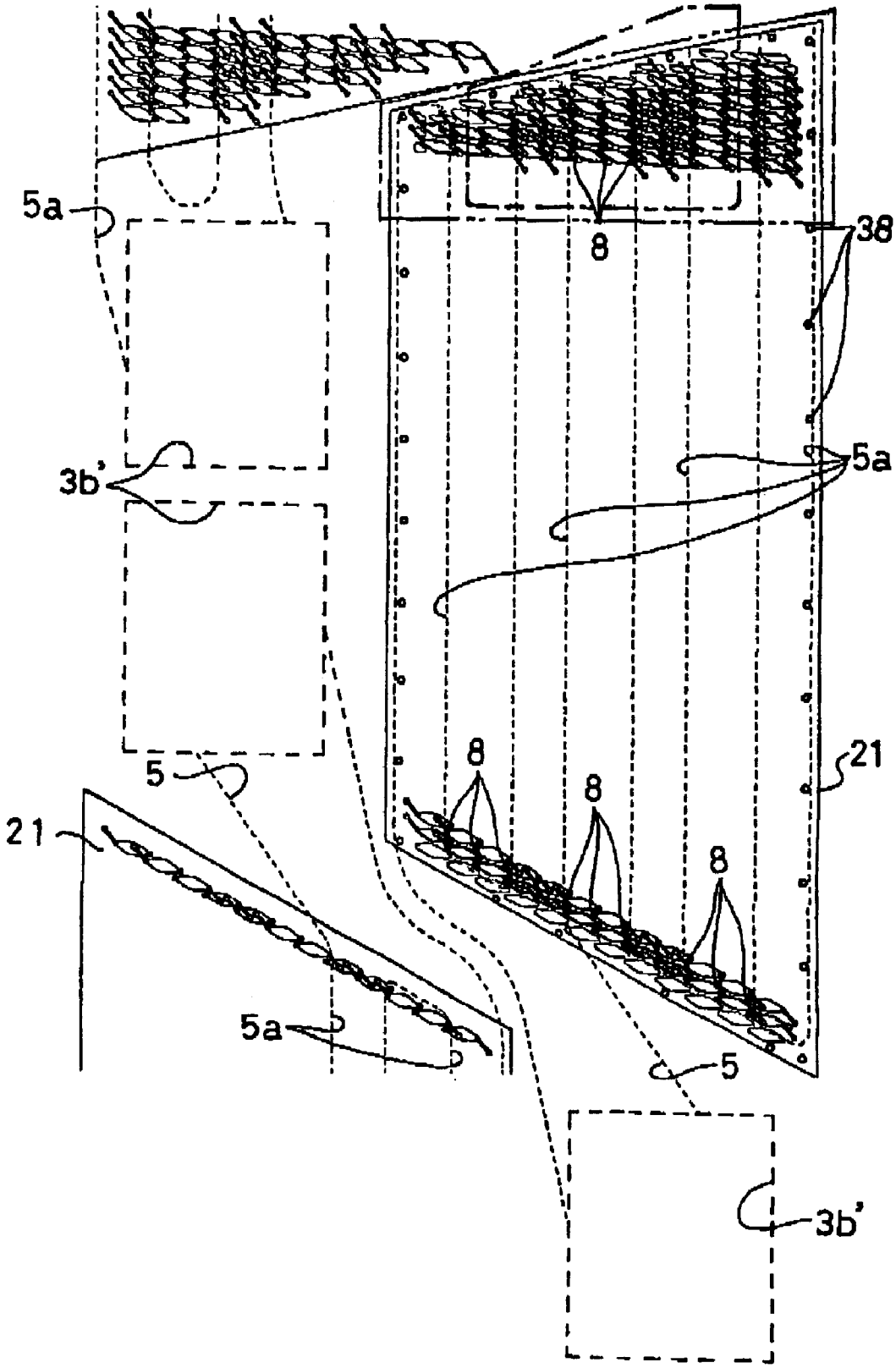
FIG. 5 is an enlarged view of the region enclosed with an alternate long and short dash line illustrated in FIG. 4.

FIG. 5 is an enlarged view of the region enclosed with an alternate long and short dash line illustrated in FIG. 4. Referring to FIG. 4 and FIG. 5, the ink reservoir 3 communicates with a manifold channel 5 at inside of the passage unit 4 via openings 3*b* formed in correspondence with the ink reservoir 3 and openings 3*b*' on the side of the passage unit 4 formed in correspondence with the opening 3*b*. Each opening 3*b*' is provided with a filter (not shown) for catching dust and dirt contained in ink. A front end portion of the manifold channel 5 branches into two sub-manifold channels 5*a*. Below a single actuator unit 21, two sub-manifold channels 5*a* extend from each of the two openings 3*b*' on both sides of the actuator unit 21 in the longitudinal direction of the ink-jet head 1. That is, below the single actuator unit 21, a total of four sub-manifold channels 5*a* extend along the longitudinal direction of the ink-jet head 1. Each sub-manifold channel 5*a* is filled up with ink supplied from the ink reservoir 3 via the opening 3*b* on the side of the base block 75 and the opening 3*b*' on the side of the passage unit 4.

As mentioned above, ink in the ink reservoir 3 is supplied to the passage unit 4 from the plurality of openings 3*b*' uniformly provided along the longitudinal direction of the passage unit 4. As shown by FIG. 4, each of the openings 3*a* is disposed in correspondence with the respective actuator unit 21 arranged above the passage unit 4. Therefore, even when the head is elongated, ink is reliably supplied to the passage unit 4.

Figure 6:
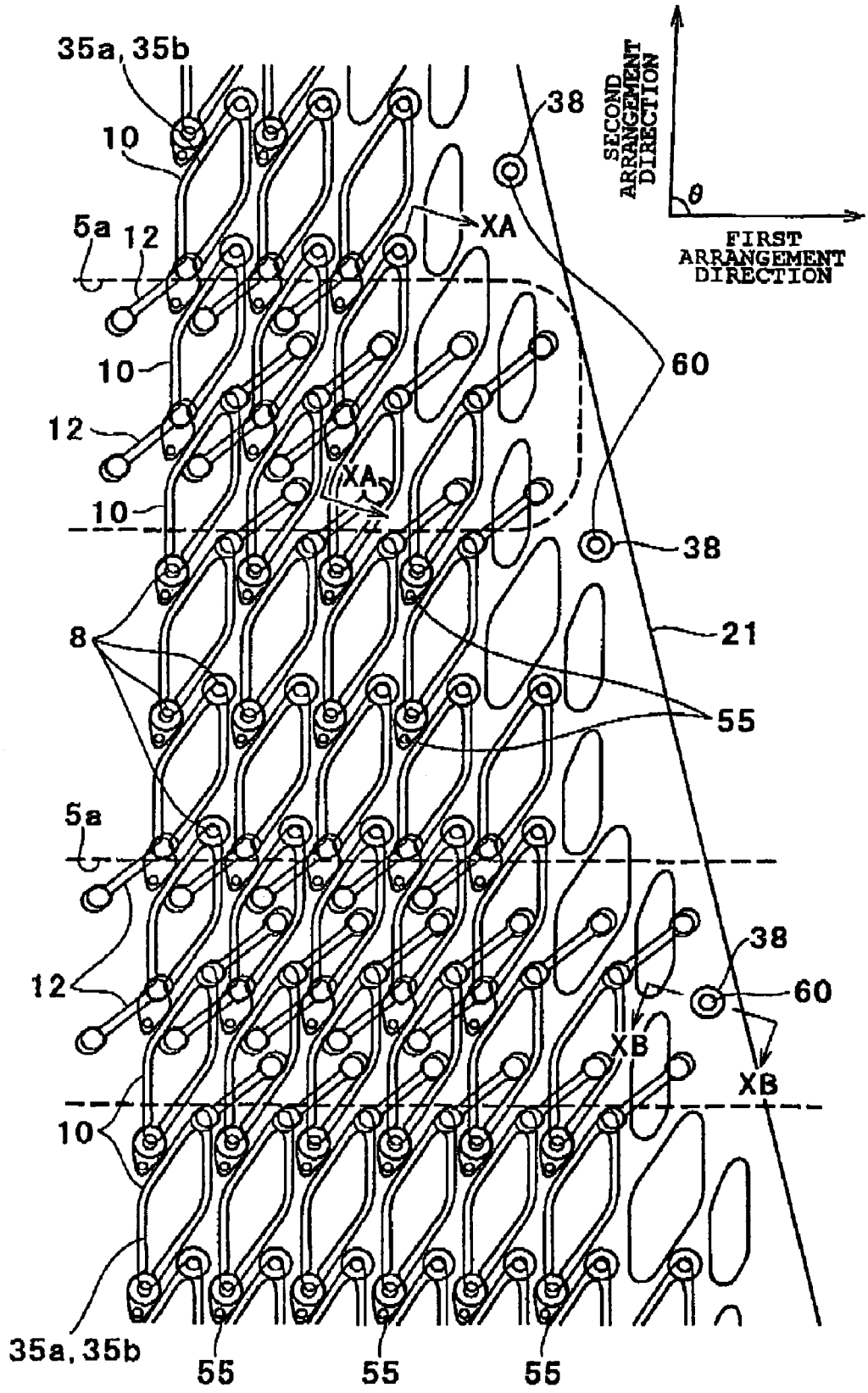
FIG. 6 is an enlarged view of a region enclosed with an alternate long and short dash line illustrated in FIG. 5.

FIG. 6 is an enlarged view of a region enclosed with an alternate long and short dash line illustrated in FIG. 5. Referring to FIGS. 5 and 6, on the upper face of each actuator unit 21, individual electrodes 35*a*, each having a nearly rhombic shape in a plan view, are regularly arranged in a matrix. In addition, individual electrodes 35*b*, having the same shape as the individual electrodes 35*a*, are disposed in the actuator unit 21 to vertically overlap the respective individual electrodes 35*a*. A large number of ink ejection ports 8 are regularly arranged in a matrix in the surface of the ink ejection region corresponding to the actuator unit 21 of the passage unit 4. In the passage unit 4, pressure chambers (cavities) 10 having a nearly rhombic shape in a plan view somewhat larger than that of the individual electrodes 35*a* and 35*b* are regularly arranged in a matrix. Besides in the passage unit 4, apertures 12 are also regularly arranged in a matrix. These pressure chambers 10 and apertures 12 communicate with the corresponding ink ejection ports 8. The pressure chambers 10 are provided at positions corresponding to the respective individual electrodes 35*a* and 35*b*. In a plan view, the large part of the individual electrodes 35*a* and 35*b* are included in a region of the corresponding pressure chamber 10. In FIGS. 5 and 6, for ease in understanding the drawings, the pressure chambers 10, the apertures 12, etc., are illustrated with solid lines although they should be illustrated with broken lines because they are within the actuator unit 21 or the passage unit 4. Further, in FIG. 6, for ease of explanation, connection pads 55, 60, provided on the side of the FPC 50 attached on the upper face of the actuator unit 21, are drawn.

As shown in FIG. 5 and FIG. 6, a number of ground electrodes 38, each having a circular shape, are formed at the vicinity of an outer edge portion of the upper face of the actuator unit 21. The ground electrodes 38 are spaced apart from each other such that intervals between adjacent ones thereof are substantially equal. Therefore, a region in the upper face of the actuator unit 21 formed with the individual electrodes 35*a* is surrounded by a number of the ground electrodes 38 over the entire periphery thereof.

Figure 7:
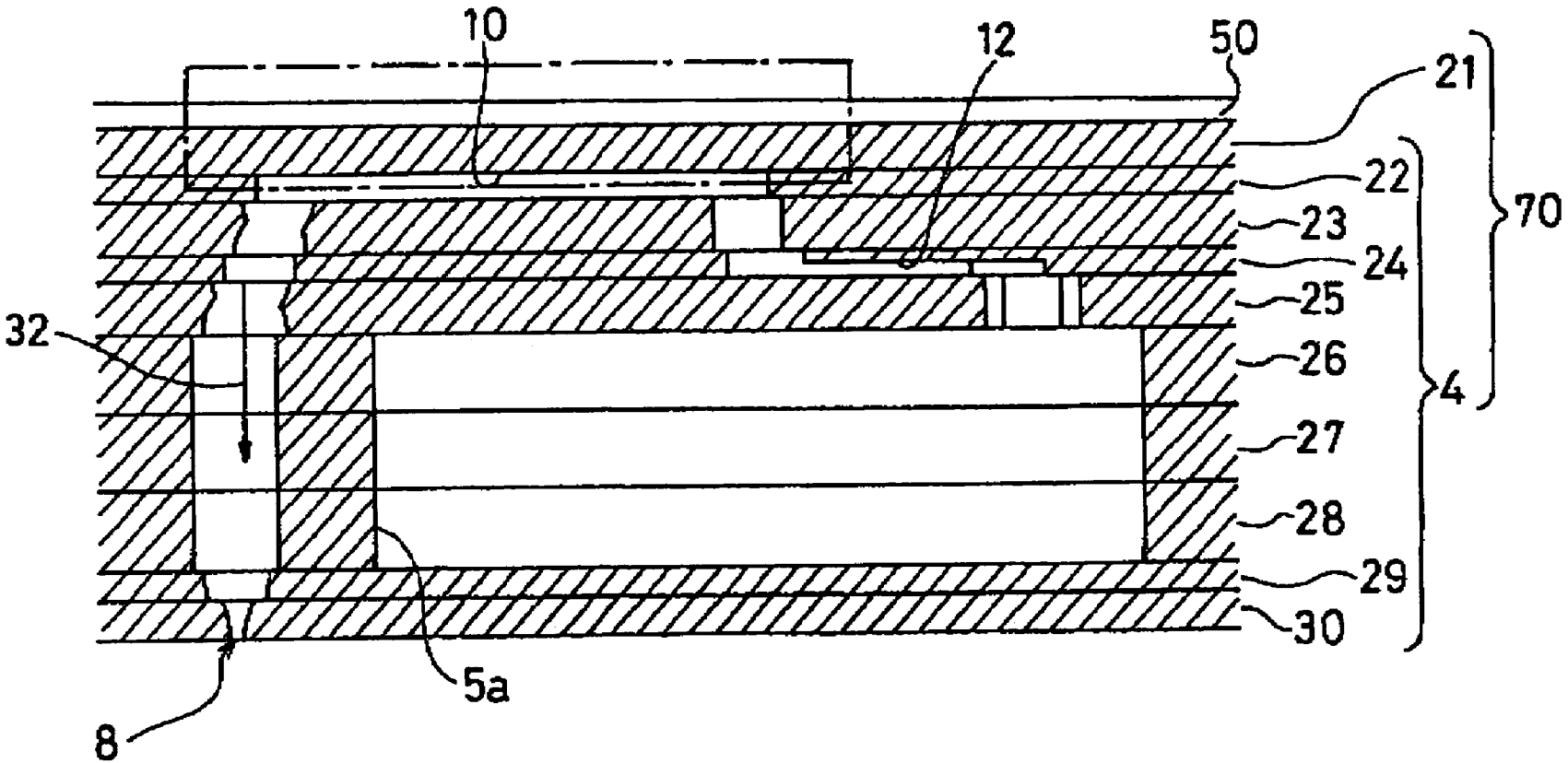
FIG. 7 is a partially sectional view of the head unit illustrated in FIG. 2 and a flexible printed circuit attached thereon.

FIG. 7 is a partially sectional view of the head unit illustrated in FIG. 2 and a flexible printed circuit attached thereon. As apparent from FIG. 7, each ink ejection port 8 is formed at the front end of a tapered nozzle. Each ink ejection port 8 communicates with a sub-manifold channel 5*a* through a pressure chamber 10 (length: 900 microns, width: 350 microns) and an aperture 12. Thus, within the formed ink-jet head 1, a number of ink passages 32 are provided that extend from an ink tank to an ink ejection port 8 through an ink reservoir 3, a manifold channel 5, a sub-manifold channel 5*a*, an aperture 12, and a pressure chamber 10.

Referring to FIG. 7, the pressure chamber 10 and the aperture 12 are provided at different levels. Therefore, in the portion of the passage unit 4 corresponding to the ink ejection region under an actuator unit 21, an aperture 12 communicating with one pressure chamber 10 can be disposed within the same portion in plan view as a pressure chamber 10 neighboring the pressure chamber 10 communicating with the aperture 12. As a result, because pressure chambers 10 can be arranged close to each other at a high density, high resolution image printing can be achieve with an ink-jet head 1 having a relatively small working area.

In FIGS. 5 and 6, pressure chambers 10 are arranged within an ink ejection region in two directions, i.e., a direction along the longitudinal direction of the ink-jet head 1 (first arrangement direction) and a direction somewhat inclining from the lateral direction of the ink-jet head 1 (second arrangement direction). The first and second arrangement directions form an angle theta somewhat smaller than the right angle. The ink ejection ports 8 are arranged at 50 dpi in the first arrangement direction. On the other hand, the pressure chambers 10 are arranged in the second arrangement direction such that the ink ejection region corresponding to one actuator unit 21 include twelve pressure chambers 10. Therefore, within the whole width of the ink-jet head 1, in a region of the interval between two ink ejection ports 8 neighboring each other in the first arrangement direction, there are twelve ink ejection ports 8. At both ends of each ink ejection region in the first arrangement direction (corresponding to an oblique side of the actuator unit 21), the above condition is satisfied by making a compensation relation to the ink ejection region corresponding to the opposite actuator unit 21 in the lateral direction of the ink-jet head 1. Therefore, in the ink-jet head 1, by ejecting ink droplets in order through a large number of ink ejection ports 8 arranged in the first and second directions with relative movement of an image recording medium along the lateral direction of the ink-jet head 1, printing at 600 dpi in the main scanning direction can be performed.

Figure 8:
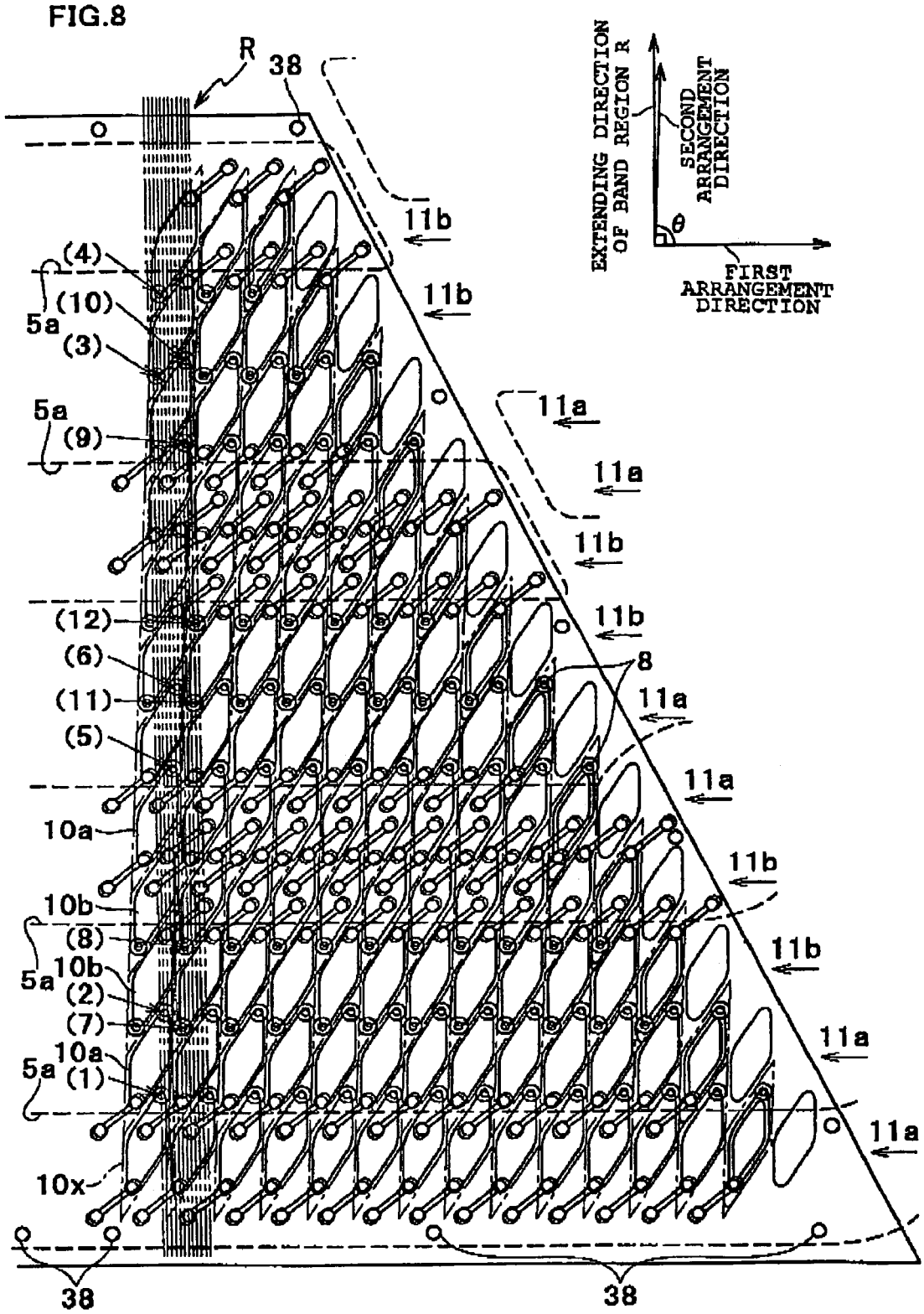
FIG. 8 is an enlarged view of the region enclosed with an alternate long and two short dashes line in FIG. 5.

Next, the construction of the passage unit 4 will be described in more detail with reference to FIG. 8. FIG. 8 is a schematic view showing the positional relation among each pressure chamber 10, each ink ejection port 8, and each aperture (restricted passage) 12. Referring to FIG. 8, pressure chambers 10 are arranged in lines in the first arrangement direction at predetermined intervals at 500 dpi. Twelve lines of pressure chambers 10 are arranged in the second arrangement direction. As the whole, the pressure chambers 10 are two-dimensionally arranged in the ink ejection region corresponding to one actuator unit 21.

The pressure chambers 10 are classified into two kinds, i.e., pressure chambers 10*a* in each of which a nozzle is connected with the upper acute portion in FIG. 8, and pressure chambers 10*b* in each of which a nozzle is connected with the lower acute portion. Pressure chambers 10*a* and 10*b* are arranged in the first arrangement direction to form pressure chamber lines 11*a* and 11*b*, respectively. Referring to FIG. 8, in the ink ejection region corresponding to one actuator unit 21, from the lower side of FIG. 8, there are disposed two pressure chamber lines 11*a* and two pressure chamber lines 11*b* neighboring the upper side of the pressure chamber lines 11*a*. The four pressure chamber lines of the two pressure chamber lines 11*a* and the two pressure chamber lines 11*b* constitute a set of pressure chamber lines. Such a set of pressure chamber lines is repeatedly disposed three times from the lower side in the ink ejection region corresponding to one actuator unit 21. A straight line extending through the upper acute portion of each pressure chamber in each pressure chamber lines 11*a* and 11*b* crosses the lower oblique side of each pressure chamber in the pressure chamber line neighboring the upper side of that pressure chamber line.

As described above, when viewing perpendicularly to FIG. 8, two first pressure chamber lines 11*a* and two pressure chamber lines 11*b*, in which nozzles connected with pressure chambers 10 are disposed at different positions, are arranged alternately neighboring each other. Consequently, as the whole, the pressure chambers 10 are arranged regularly or uniformly. On the other hand, nozzles are arranged in a concentrated manner in a central region of each set of pressure chamber lines forming by the above four pressure chamber lines. Therefore, in case that each four pressure chamber lines constitute a set of pressure chamber lines and such a set of pressure chamber lines is repeatedly disposed three times from the lower side as described above, there is formed a region where no nozzle exists, in the vicinity of the boundary between each neighboring sets of pressure chamber lines, i.e., on both sides of each set of pressure chamber lines constituted by four pressure chamber lines. Wide sub-manifold channels 5*a* extend there for supplying ink to the corresponding pressure chambers 10. In this ink-jet head, in the ink ejection region corresponding to one actuator unit 21, four wide sub-manifold channels 5*a* in total are arranged in the first arrangement direction, i.e., one on the lower side of FIG. 8, one between the lowermost set of pressure chamber lines and the second lowermost set of pressure chamber lines, and two on both sides of the uppermost set of pressure chamber lines.

Referring to FIG. 8, nozzles communicating with ink ejection ports 8 for ejecting ink are arranged in the first arrangement direction at regular intervals at 50 dpi to correspond to the respective pressure chambers 10 regularly arranged in the first arrangement direction. On the other hand, while twelve pressure chambers 10 are regularly arranged also in the second arrangement direction forming an angle q with the first arrangement direction, twelve nozzles corresponding to the twelve pressure chambers 10 include ones each communicating with the upper acute portion of the corresponding pressure chamber 10 and ones each communicating with the lower acute portion of the corresponding pressure chamber 10, as a result, they are not regularly arranged in the second arrangement direction at regular intervals.

If all nozzles communicate with the same-side acute portions of the respective pressure chambers 10, the nozzles are regularly arranged also in the second arrangement direction at regular intervals. In this case, nozzles are arranged so as to shift in the first arrangement direction by a distance corresponding to 600 dpi as resolution upon printing per pressure chamber line from the lower side to the upper side of FIG. 8. In contrast, in this ink-jet head, because four pressure chamber lines of two pressure chamber lines 11*a* and two pressure chamber lines 11*b* form a set of pressure chamber lines and such a set of pressure chamber lines is repeatedly disposed three times from the lower side, the shift of nozzle position in the first arrangement direction per pressure chamber line from the lower side to the upper side of FIG. 8 is not always the same.

In the ink-jet head 1, a band region R will be discussed that has a width (about 508.0 $\mu$m) corresponding to 50 dpi in the first arrangement direction and extends perpendicularly to the first arrangement direction. In this band region R, any of twelve pressure chamber lines includes only one nozzle. That is, when such a band region R is defined at an optional position in the ink ejection region corresponding to one actuator unit 21, twelve nozzles are always distributed in the band region R. The positions of points respectively obtained by projecting the twelve nozzles onto a straight line extending in the first arrangement direction are distant from each other by a distance corresponding to 600 dpi as resolution upon printing.

When the twelve nozzles included in one band region R are denoted by (1) to (12) in order from one whose projected image onto a straight line extending in the first arrangement direction is the leftmost, the twelve nozzles are arranged in the order of (1), (7), (2), (8), (5), (11), (6), (12), (9), (3), (10), and (4) from the lower side.

In the thus-constructed ink-jet head 1, by properly driving active layers in the actuator unit 21, a character, an figure, or the like, having a resolution of 600 dpi can be formed. That is, by selectively driving active layers corresponding to the twelve pressure chamber lines in order in accordance with the transfer of a print medium, a specific character or figure can be printed on the print medium.

By way of example, a case will be described wherein a straight line extending in the first arrangement direction is printed at a resolution of 600 dpi. First, a case will be briefly described wherein nozzles communicate with the same-side acute portions of pressure chambers 10. In this case, in accordance with transfer of a print medium, ink ejection starts from a nozzle in the lowermost pressure chamber line in FIG. 8. Ink ejection is then shifted upward with selecting a nozzle belonging to the upper neighboring pressure chamber line in order. Ink dots are thereby formed in order in the first arrangement direction with neighboring each other at 600 dpi. Finally, all the ink dots form a straight line extending in the first arrangement direction at a resolution of 600 dpi.

On the other hand, in this ink-jet head, ink ejection starts from a nozzle in the lowermost pressure chamber line 11*a* in FIG. 8, and ink ejection is then shifted upward with selecting a nozzle communicating with the upper neighboring pressure chamber line in order in accordance with transfer of a print medium. In this embodiment, however, because the positional shift of nozzles in the first arrangement direction per pressure chamber line from the lower side to the upper side is not always the same, ink dots formed in order in the first arrangement direction in accordance with the transfer of the print medium are not arranged at regular intervals at 600 dpi.

More specifically, as shown in FIG. 8, in accordance with the transfer of the print medium, ink is first ejected through a nozzle (1) communicating with the lowermost pressure chamber line 11*a* in FIG. 8 to form a dot row on the print medium at intervals corresponding to 50 dpi (about 508.0 μm). After this, as the print medium is transferred and the straight line formation position has reached the position of a nozzle (7) communicating with the second lowermost pressure chamber line 11*a*, ink is ejected through the nozzle (7). The second ink dot is thereby formed at a position shifted from the first formed dot position in the first arrangement direction by a distance of six times the interval corresponding to 600 dpi (about 42.3 μm) (about 42.3 μm*6=about 254.0 μm).

Next, as the print medium is further transferred and the straight line formation position has reached the position of a nozzle (2) communicating with the third lowermost pressure chamber line 11*b*, ink is ejected through the nozzle (2). The third ink dot is thereby formed at a position shifted from the first formed dot position in the first arrangement direction by a distance of the interval corresponding to 600 dpi (about 42.3 μm). As the print medium is further transferred and the straight line formation position has reached the position of a nozzle (8) communicating with the fourth lowermost pressure chamber line 11*b*, ink is ejected through the nozzle (8). The fourth ink dot is thereby formed at a position shifted from the first formed dot position in the first arrangement direction by a distance of seven times the interval corresponding to 600 dpi (about 42.3 μm) (about 42.3μm*7=about 296.3 μm). As the print medium is further transferred and the straight line formation position has reached the position of a nozzle (5) communicating with the fifth lowermost pressure chamber line 11*a*, ink is ejected through the nozzle (5). The fifth ink dot is thereby formed at a position shifted from the first formed dot position in the first arrangement direction by a distance of four times the interval corresponding to 600 dpi (about 42.3 μm) (about 42.3 μμm*4=about 169.3 μm).

After this, in the same manner, ink dots are formed with selecting nozzles communicating with pressure chambers 10 in order from the lower side to the upper side in FIG. 8. In this case, when the number of a nozzle in FIG. 8 is N, an ink dot is formed at a position shifted from the first formed dot position in the first arrangement direction by a distance corresponding to (magnification n=N−1)*(interval corresponding to 600 dpi). When the twelve nozzles have been finally selected, the gap between the ink dots to be formed by the nozzles (1) in the lowermost pressure chamber lines 11*a* in FIG. 8 at an interval corresponding to 50 dpi (about 508.0 μm) is filled up with eleven dots formed at intervals corresponding to 600 dpi (about 42.3 μm. Therefore, as the whole, a straight line extending in the first arrangement direction can be drawn at a resolution of 600 dpi.

Figure 9:
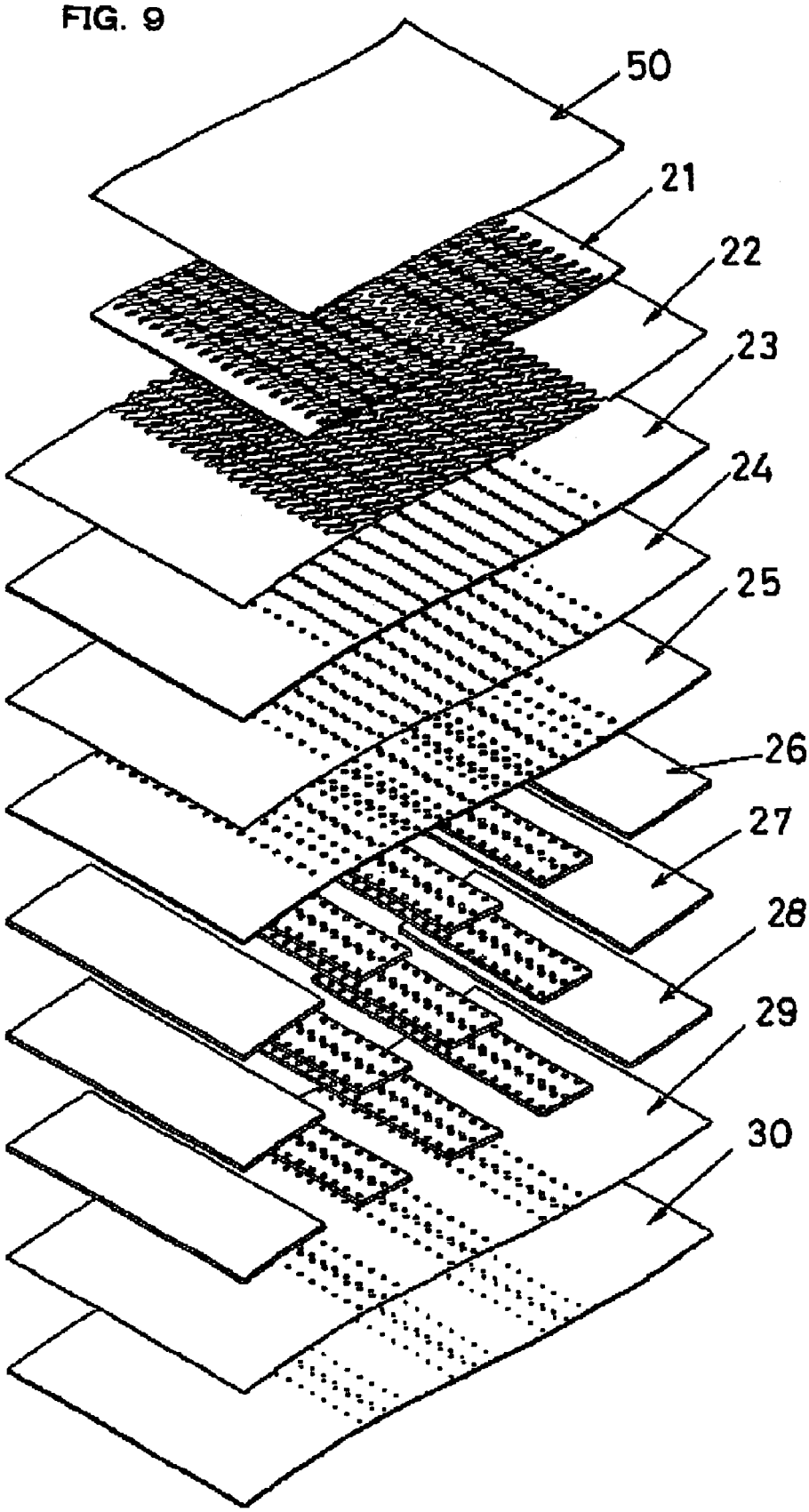
FIG. 9 is a partially exploded perspective view of the head unit illustrated in FIG. 2 and the flexible printed circuit attached thereon.

Next, the sectional construction of the ink-jet head 1 will be described. FIG. 9 is a partially exploded perspective view of the head unit illustrated in FIG. 2 and the flexible printed circuit attached thereon. As shown in FIG. 7 and FIG. 9, a principal portion on the bottom side of the ink-jet head 1 has a layered structure laminated with a total of eleven sheets materials in total, i.e., from the top, the FPC 50, the actuator unit 21, a cavity plate 22, a base plate 23, an aperture plate 24, a supply plate 25, manifold plates 26, 27, 28, a cover plate 29, and the nozzle plate 30. Of the above, nine plates other than the actuator unit 21 and the FPC 136 form a passage unit 4.

As described later in details, actuator unit 21 is laminated with five piezoelectric sheets and provided with electrodes so that three layers include portions to be active when an electric field is applied (hereinafter, simply referred to as "layer including active layers (active portions)") and the remaining two layers are inactive. The cavity plate 22 is made of metal, in which a large number of substantially rhombic openings are formed corresponding to the respective pressure chambers 10. The base plate 23 is made of metal, in which a communication hole is formed between each pressure chamber 10 of the cavity plate 22 and the corresponding aperture 12, and a communication hole is formed between the pressure chamber 10 and the corresponding ink ejection port 8. The aperture plate 24 is made of metal, in which, in addition to apertures 12, communication holes are formed for connecting each pressure chamber 10 of the cavity plate 22 with the corresponding ink ejection port 8. The supply plate 25 is made of metal, in which communication holes are formed between each aperture 12 and the corresponding sub-manifold channel 5*a* and communication holes are formed for connecting each pressure chamber 10 of the cavity plate 22 with the corresponding ink ejection port 8. Each of the manifold plates 26, 27, and 28 is made of metal, which defines an upper portion of each sub-manifold channel 5*a* and in which communication holes are formed for connecting each pressure chamber 10 of the cavity plate 22 with the corresponding ink ejection port 8. The cover plate 29 is made of metal, in which communication holes are formed for connecting each pressure chamber 10 of the cavity plate 22 with the corresponding ink ejection port 8. The nozzle plate 30 is made of metal, in which tapered ink ejection ports 8 each functioning as a nozzle are formed for the respective pressure chambers 10 of the cavity plate 22.

The pressure chamber 10 is formed by closing an opening face provided to openings for forming the pressure chamber 10 of the cavity plate 22 by the lower face of the actuator unit 21, and closing other opening face by an upper face of the base plate 23 disposed below the cavity plate 22. Further, the sub manifold 5*a* for supplying ink to the respective pressure chamber 10 is formed by closing an upper side opening face of openings for forming the sub manifold 5*a* of the manifold plate 26 by the lower face of the supply plate 25 and closing a lower side opening of the opening for forming the sub manifold 5*a* of the manifold plate 28 by the upper face of the cover plate 29.

The ten sheets 21 to 30 are being positioned in layers to each other to form such an ink passage 32 as illustrated in FIG. 7. The ink passage 32 first extends upward from the sub-manifold channel 5*a*, then extends horizontally in the aperture 12, then further extends upward, then again extends horizontally in the pressure chamber 10, then extends obliquely downward in a certain length away from the aperture 12, and then extends vertically downward toward the ink ejection port 8. Further, FPC 50 is laminated to be disposed to an electrode arranged at the actuator unit 21.

Figure 10A:
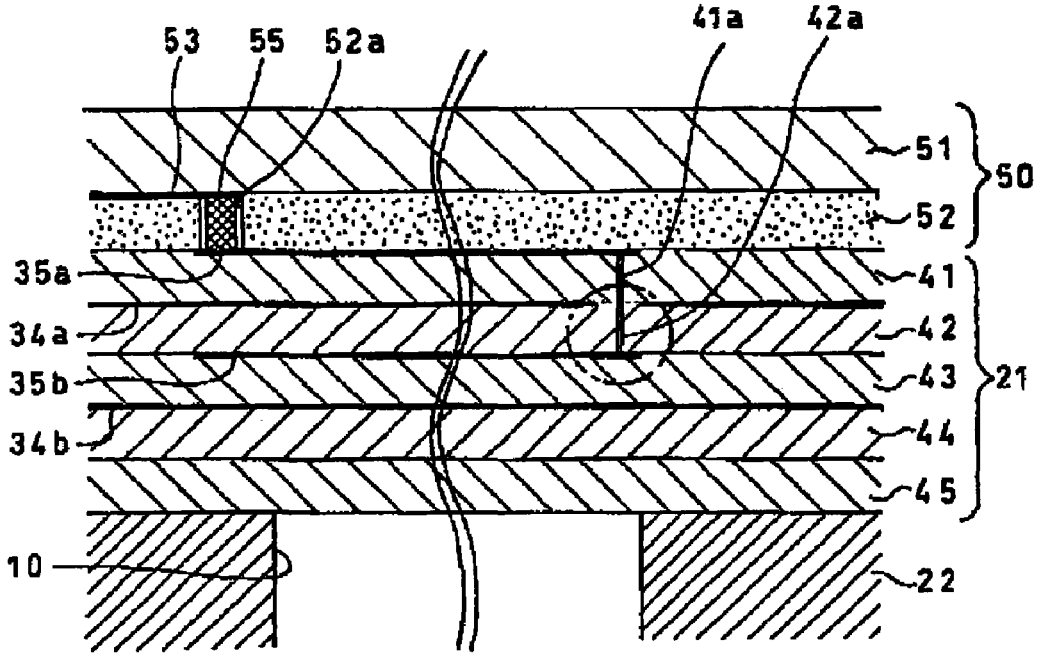
FIG. 10A is a sectional view of an actuator unit attached with the flexible printed circuit taken along a line XA—XA illustrated in FIG. 6 and is an enlarged view of a region surrounded by an alternate long and short dash line illustrated in FIG. 7.
Figure 10B:
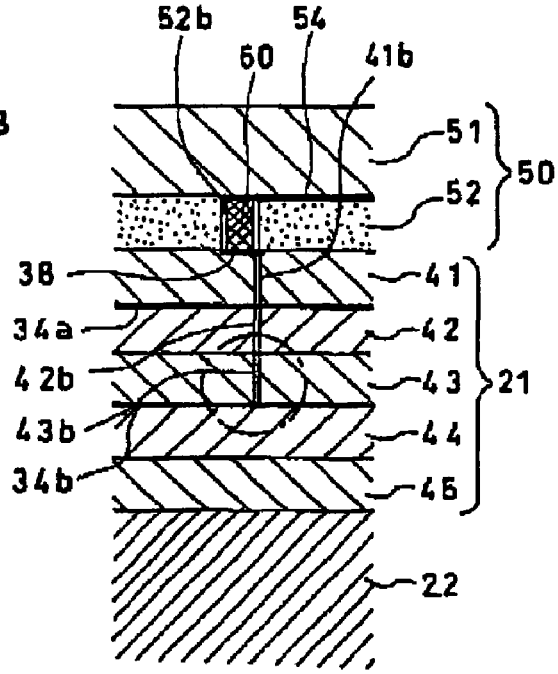
FIG. 10B is a sectional view of the actuator unit attached with the flexible printed circuit taken along a line XB—XB illustrated in FIG. 6.
Figure 10C:
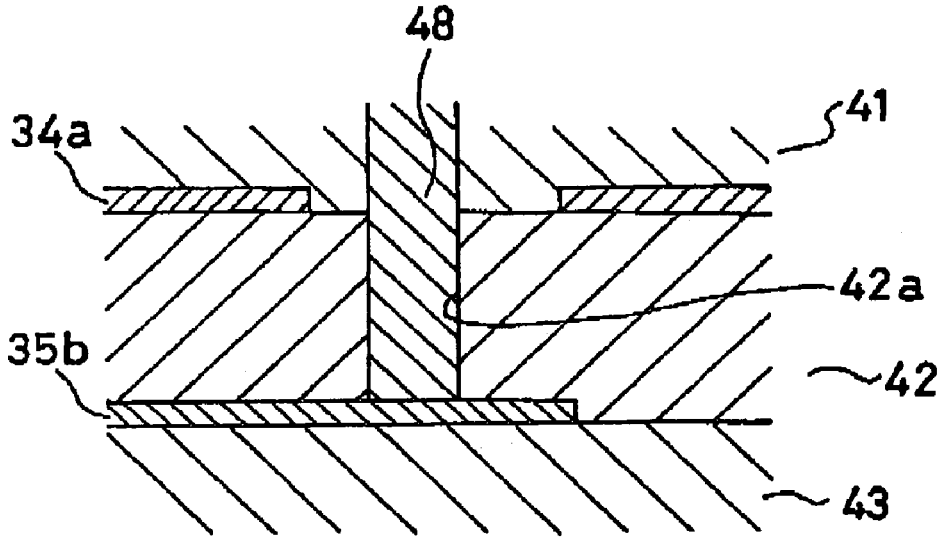
FIG. 10C is an enlarged view of a circular frame illustrated by an alternate long and short dash line of FIG. 10A.
Figure 10D:
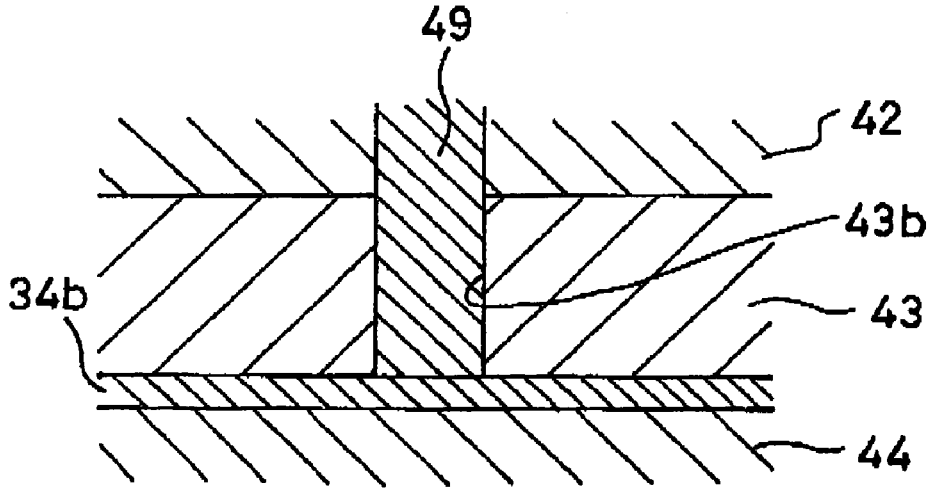
FIG. 10D is an enlarged view of a circular frame illustrated by an alternate long and short dash line of FIG. 10B.

Next, an explanation will be given of a structure of the actuator unit 21 and connection between the actuator unit 21 and the FPC 50. FIG. 10A is a sectional view of the actuator unit attached with the FPC 50 taken along a line XA—XA illustrated in FIG. 6 and is an enlarged view of a region surrounded by an alternate long and short dash line illustrated in FIG. 7. FIG. 10B is a sectional view of the actuator unit attached with the FPC 50 taken along a line XB—XB illustrated in FIG. 6. FIG. 10C is an enlarged view of a circular frame illustrated by an alternate long and short dash line of FIG. 10A. FIG. 10D is an enlarged view of a circular frame illustrated by an alternate long and short dash line of FIG. 10B.

Referring to FIG. 10A and FIG. 10B, the actuator unit 21 includes five piezoelectric sheets 41, 42, 43, 44, and 45, each having the same thickness of about 15 microns. These piezoelectric sheets 41 to 45 are made into a continuous layered flat plate (continuous flat layers) that is disposed so as to extend over many pressure chambers 10 formed within one ink ejection region in the ink-jet head 1. Since the piezoelectric sheets 41 to 45 are disposed to extend over many pressure chambers 10 as continuous flat layers, the individual electrodes 35*a* and 35*b* can be arranged at a high density by using, e.g., a screen printing technique. Therefore, the pressure chambers 10 formed at positions corresponding to the individual electrodes 35*a* and 35*b* can be arranged at a high density. This makes it possible to print a high-resolution image. In this embodiment, each of the piezoelectric sheets 41 to 45 is made of a lead zirconate titanate (PZT)-base ceramic material having ferroelectricity. Although FIG. 7 and FIG. 9A show that the FPC 50 and the piezoelectric sheets 41 are adhered to each other over the entire surface thereof, they are actually not adhered at the main electrode portion 60 of each individual electrode 35*a*. This structure is to prevent the FPC 50 attached to the main electrode portion 60 from obstructing the deformation of the actuator unit 21 and the pressure chamber 10. A similar description can be applied to FIG. 11A.

As shown in FIG. 10A, through holes 41*a*, 42*a* are formed at the piezoelectric sheets 41, 42 between positions corresponding to one end side (end of opposite to the auxiliary electrode portions 91)of the main electrode portions 90 of the individual electrode 35*a* and the individual electrode 35*b*. As shown in FIG. 10C, the through holes 41*a* and 42*a* are filled with a conductive material (silver palladium) 48. The individual electrode 35*a* and the individual electrode 35*b* are connected to each other via the conductive material 48 such that the connected two electrodes correspond to the same pressure chamber 10.

As shown in FIG. 10B, through holes 41*b*, 42*b*, 43*b* penetrating the piezoelectric sheets 41, 42, 43 are formed below the ground electrode 38. As shown in FIG. 9B, the through holes 41*b*, 42*b*, 43*b* are filled with a conductive material (silver palladium) 49. The ground electrode 38 is connected to the common electrode 34*a* and the common electrode 35*b* via the conductive material 49.

An about 2 microns thick common electrode 34*a* is interposed formed on the whole of the lower and upper faces of the piezoelectric sheets between the uppermost piezoelectric sheet 41 and the piezoelectric sheet 42 neighboring downward the piezoelectric sheet 41. The common electrode 34*a* is a conductive sheet extended over substantially the entire region of a single actuator unit 21. Also, an about 2 microns thick common electrode 34*b* is interposed and formed like the common electrode 34*a* between the piezoelectric sheet 43 neighboring downward the piezoelectric sheet 42 and the piezoelectric sheet 44 neighboring downward the piezoelectric sheet 43.

In a modification, many pairs of common electrodes 34*a* and 34*b*, each having a shape larger than that of a pressure chamber 10 so that the projection image of each common electrode projected along the thickness direction of the common electrode may include the pressure chamber, may be provided for each pressure chamber 10. In another modification, many pairs of common electrodes 34*a* and 34*b*, each having a shape somewhat smaller than that of a pressure chamber 10 so that the projection image of each common electrode projected along the thickness direction of the common electrode may be included in the pressure chamber, may be provided for each pressure chamber 10. Thus, the common electrode 34*a* or 34*b* may not always be a single conductive sheet formed on the whole of the face of a piezoelectric sheet. In the above modifications, however, all the common electrodes must be electrically connected with one another so that the portion corresponding to any pressure chamber 10 may be at the same potential.

As shown in FIG. 10A, the individual electrode 35*a* having a thickness of about 1 microns is formed on the upper face of the piezoelectric sheets 41 at a position corresponding to the pressure chamber 10. The individual electrode 35*a*(length:850 microns, width:250 microns) has a shape substantially similar to that of the pressure chamber 10 (see FIG. 6 and FIG. 11).

Figure 11:
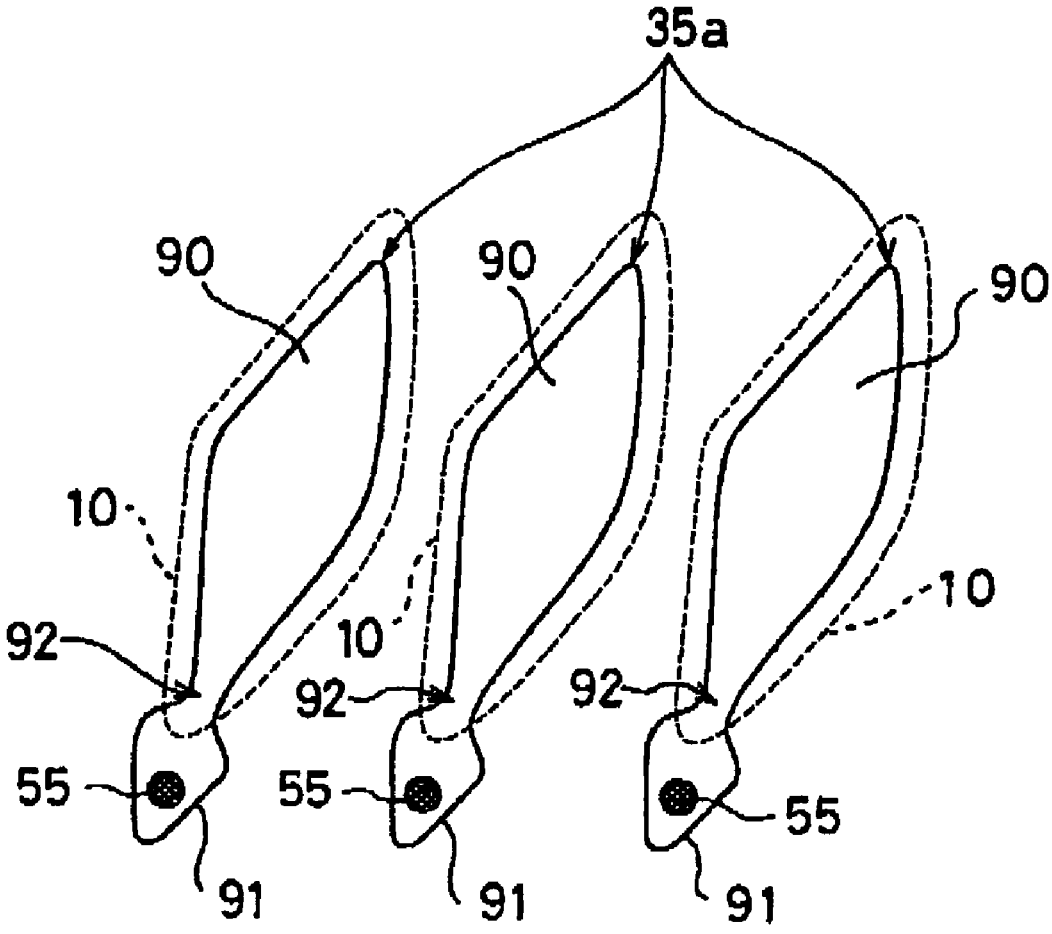
FIG. 11 is a schematic partially enlarged plan view of FIG. 6.

FIG. 11 is a schematic partially enlarged plan view of FIG. 6. The individual electrode 35*a* includes a substantially rhombic main electrode portion 90, and two substantially rhombic auxiliary electrode portions 91 having a shape smaller than the main electrode portion 90. The auxiliary electrode portions 91 are formed continuously from each acute portion at both ends thereof. The image of the main electrode portion 90 projected along the lamination direction is included within the corresponding pressure chamber region (the region surrounded by broken lines in FIG. 11). Moreover, the image of the auxiliary electrode portion 91 projected along the lamination direction is mostly not included in the pressure chamber region.

As shown in FIG. 11, the width of a interconnecting part 92 for connecting the main electrode portion 90 and the auxiliary electrode portion 91, length with respect to the direction orthogonal to the direction connecting the main electrode portion 90 and the auxiliary electrode portion 91, is smaller than both the width of the main electrode portion 90 and the width of the auxiliary electrode portion 91 in the individual electrode 35*a*. That is, in the individual electrode 35*a*, the interconnecting parts 92 for connecting the main electrode portion 90 and the auxiliary electrode portions 91 is formed in a constricted shape.

Further, the individual electrode 35*b* having a shape similar to the individual electrode 35*a* and having a thickness of about 2 microns is interposed at a position, between the piezoelectric sheet 42 and piezoelectric sheet 43. Meanwhile, no electrode is arranged between the piezoelectric sheet 44 and the piezoelectric sheet 45 neighboring downward thereof and the lower side of the piezoelectric sheet 45. In this embodiment, each of the electrodes 34*a*, 34*b*, 35*a*, and 35*b* is made of, e.g., an Ag—Pd-base metallic material.

The FPC 50 is a member for connecting the individual electrodes 35*a*, 35*b* and the common electrodes 34*a*, 34*b* of the actuator unit 21 to the driver IC 80. As shown in FIG. 10A and FIG. 10B, the FPC 50 includes connection pads 55,60 at a lower face thereof, which are electrically bonded by soldering to the individual electrode 35*a* and the ground electrode 38 arranged at the upper face of the actuator unit 21.

FPC 50 includes a base film 51, conductor portions 53 and 54 provided below the base film 51, and a cover film 52 provided to cover the conductor portions 53 and 54 substantially over an entire face of the base film 51. Further, as shown by FIG. 10A and FIG. 10B, FPC 50 is arranged such that the cover film 52 is brought into contact with the upper face of the piezoelectric sheet 41 which is the uppermost layer of the actuator unit 21. Further, both of the base film 51 and the cover film 52 are insulating sheet-like members.

Here, as shown by FIG. 10A, the conductive connection pad 55 is provided at the lower face of the base film 51 at a position in correspondence with one end of the individual electrode 35*a*. That is, the connection pad 55 is provided at a position in correspondence with the auxiliary electrode portion 91 of the individual electrode 35*a*. Therefore, each of the individual electrode 35*a* is provided with each of the connection pad 55.

Further, as shown by FIG. 10B, a conductive connection pad 60 is provided at a lower face of the base film 51 at a position in correspondence with the grounding electrode 38 formed at the vicinity of the outer edge of the upper face of the actuator unit 21.

Further, as shown by FIG. 10A and FIG. 10B, through holes 52*a* and 52*b*, having diameters more or less larger than diameters of the connection pad 55 and the connection pad 60, are formed at the positions in correspondence with the connection pad 55 and the connection pad 60 of the cover film 52. Therefore, almost all of portions of the lower face of the base film 51 except the connection pad 55 and connection pad 60 disposed at the positions in correspondence with the through holes 52*a* and 52*b* are covered by the cover film 52.

Further, the conductor portions 53 and 54 arranged between the base film 51 and the cover film 52 are formed by copper foils. Here, the conductor portion 53 is a wiring for connecting the connection pad 55 and the driver IC 80. Meanwhile, the conductor portion 54 is a wiring for grounding the connection pad 60. Therefore, the conductor portions 53 and 54 are provided to form a predetermined pattern at the lower face of the base frame 51.

When FPC 50 having the connection pads 55 and 60 is arranged at the upper face of the piezoelectric sheet 41 formed with the individual electrode 35*a* and the grounding electrode 38, the connection pad 55 is bonded electrically to the individual electrode 35*a*, and the connection pad 60 is bonded electrically to the grounding electrode 38. Therefore, the individual electrode 35*a* is connected to the driver IC 80 via the connection pad 55 and the conductor portion 53 and the grounding electrode 38 is grounded at a region, not illustrated, via the connection pad 60 and the conductor portion 64.

A number of individual electrodes 35*a* are connected to the driver IC 80 via the individual conductor portions 53 independent from each other. Further, the individual electrodes 35*a* and 35*b* are connected via conductive materials 48 provided at insides of the through holes 41*a* and 42*a* formed at the piezoelectric sheets 41 and 42 in correspondence with the respective pressure chambers 10. Therefore, the electrical potential of the respective individual electrodes 35*a*, 35*b* for each pressure chamber 10 independent from each other.

All of the grounding electrode 38 are connected to the common electrode 34*a* via conductive materials 49 provided at insides of the through holes 41*b* formed in the piezoelectric sheet 41. Further, the common electrodes 34*a* and 34*b* are connected via conductive materials 49 provided at insides of the through holes 42*b* and 43*b* formed at the piezoelectric sheets 42 and 43. Therefore, the common electrodes 34*a* and 34*b*, which are connected to the grounding electrodes 38 grounded via the connection pads 60 and the conductor portions 54, are maintained at ground potential equally at regions in correspondence with all of the pressure chambers 10.

Here, a number of the common electrodes 34*a* and 34*b* may be formed for the respective pressure chambers 10 such that the region projected in the laminated direction includes the pressure chamber region or the projected region is included by the pressure chamber region and need not to be a single sheet of the conductive sheet formed over entire faces of the sheets necessarily. However, it is necessary for the common electrodes to electrically connect each other such that all of the portions in correspondence with the pressure chambers 10 becomes the same potential.

Further, according to the embodiment, the electrode 38 connected to the common electrodes 34*a* and 34*b* is grounded at a region (not shown), and a predetermined drive signal is supplied from the driver IC 80 only to the individual electrode 35*a*. However, a drive signal having operation similar to grounding may be supplied from the driver IC 80 to the grounding electrode 38.

Further, as described above, the head unit 70 having the actuator unit 21 adhered to the upper face of the passage unit 4 and the FPC 50 adhered to the upper face of the actuator unit 21 are held on the lower side of the holder 72 of the support member 71. In a more detailed description, the projected portions 73*a* of the holder main body 73 of the support member 71 are arranged in correspondence with the both end portions in the sub scanning direction of the passage unit 4. The vicinity portion 76*a* of each opening 3*b* of the lower face 60 of the base block 75 is then bonded to the upper face of the passage unit 4. Further, the actuator unit 21 of the head unit 70 is disposed on the upper face of the passage unit 4 to be separate from an end portion thereof between the base block 75 and the passage unit 4. Further, as described above, the lower end portion of the base block 75 protrudes from the groove portion 73*b* of the holder main body 73 and therefore, a predetermined clearance is formed between the lower face of the projected portion 73*a* of the holder main body 73 and the upper face of the passage unit 4.

Figure 12:
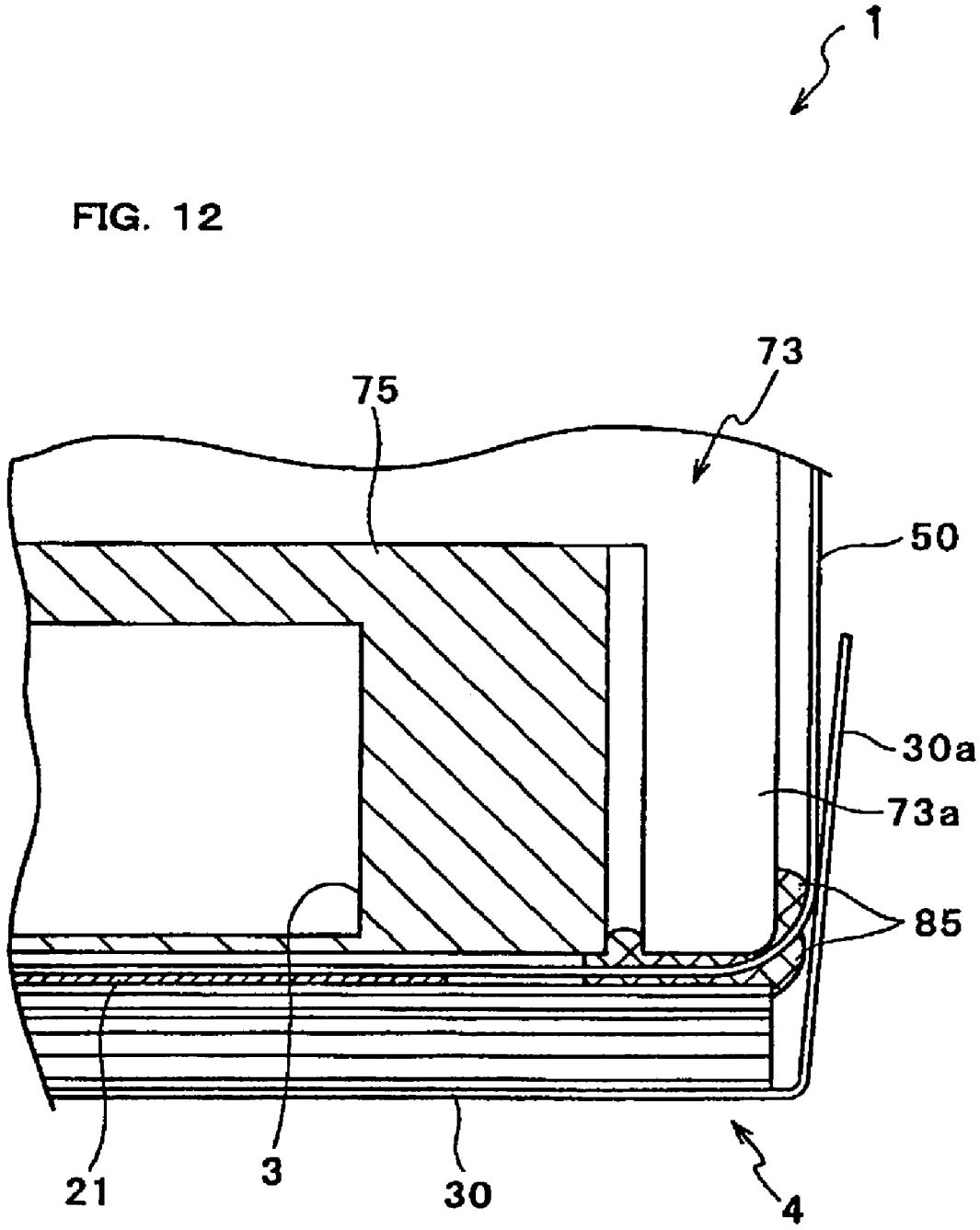
FIG. 12 is an enlarged sectional view of a vicinity of an end portion of the head unit.

Further, as shown by FIG. 3, the FPC 50 adhered to the upper face of the actuator unit 21 is extended to outside to pass between the lower face of the projected portion 73*a* of the holder main body 73 and the upper face of the passage unit 4 and thereafter arranged along the outer peripheral face of the support member 71. FIG. 12 is an enlarged sectional view of a vicinity of an end portion of the head unit 70. As shown by FIG. 12, a seal member 85 is arranged between the lower face the projected portion 73*a* of the holding mean body 73 and the upper face of the passage unit to interpose the FPC 50. Therefore, the FPC 50 is fixed to the passage unit 4 and the holder main body 73 by the seal member 85. The seal member 85 may be formed by a silicone or a like material.

Further, the interval of the portion other than the vicinity portion 76*a* of each opening 3*b* of the lower face 76 of the base block 75 and the passage unit 4 becomes larger than a total of a thickness of the actuator unit 21 and a thickness of FPC 50. Therefore, when the vicinity portion 76*a* of each opening 3*b* of the lower face 76 of the base block 75 are to be brought into contact with the passage unit 4 of the head unit 70, a predetermined clearance is formed between the upper face of FPC 50 and the portion other than the vicinity portion 76*a* of each opening 3*b* of the lower face 76 of the base block 75. Therefore, a predetermined clearance is formed between the actuator unit 21 and the base block 75.

Further, as shown by FIG. 2 and FIG. 12, both end portions in the sub scanning direction of the nozzle plate 30 arranged at the lowermost layer of the passage unit 4 are arranged with projected portions 30*a* extended to outer side direction. 6 of the projected portions 30*a* are arranged at either of the end portions of the nozzle plate 30 along the longitudinal direction (main scanning direction) and provided to be spaced apart from each other at predetermined intervals. Further, the projected portions 30*a* are folded to bend to the side of the holder 72 at positions in correspondence with the both end portions in the sub scanning direction of the passage unit 4. Further, a root portion of the projected portion 30*a* is provided with a predetermined round shape to facilitate for a front end portion of sheet to advance to a position opposed to the lower face of the nozzle plate 30 (passage unit 4). Further, also FPC 50 bonded to the upper face of the actuator unit 21 and extended is folded to bend to the side of the holder 72 and arranged along the support member 71.

In this embodiment, the projected portions 30*a* are provided in correspondence with sheet widths (sheet widths for standard sizes) used in printing at the printer 301 provided with the ink-jet head 1 at the both end portions in the sub canning direction of the nozzle plate 30. That is, the projected portions 30*a* are provided in correspondence with vicinities of the both end portions of sheet and a position at a middle thereof or in correspondence with vicinities of the both end portions of sheet and positions at which an interval therebetween are substantially uniformly divided.

Therefore, for example, when sheet is transferred in an arrow mark direction indicating the main scanning direction in FIG. 2, by defining a position on a side of an origin of print data on the outermost side in the main scanning direction as X, the projected portions 30*a* are provided at remote position A remote from the position X by a distance in correspondence with a sheet width of a standard size (for example, A4) having a maximum usable width, position B remote from the position X by a distance in correspondence with a sheet size for a standard width (for example, B5) of a size next to the maximum width, position C remote from the position X by a distance in correspondence with a width of an official postcard and position D and position E pertinently disposed between position B and position C and position C and position X.

Alternatively, the nozzle plate 30 may be extended by a predetermined length at the both end portions in the sub scanning direction to outside directions. In this case, similar to the above-projected portion 30*a*, the root portions at the both end portions in the sub scanning direction are folded to bend to the side of the holder 72 to provide the predetermined round shape. Thereby, FPC 50 is folded to bend to the side of the holder 72 by being guided by the portions of the nozzle plate 30 extended to the outer sides and arranged along the support member 71. According to the configuration, FPC 50 may be attached by arranging the seal member 85 between the projected portion 73*a* of the holder main body 73 and the extended portion of the nozzle plate 30 which is folded to bend. Therefore, as described below, stresses that could be applied to a portion connecting the actuator unit 21 and FPC 50 may be prevented and the FPC 50 can be securely held.

In the ink-jet head 1 according to the embodiment, the piezoelectric sheets 41 to 43 are polarized in their thickness direction. Therefore, when the individual electrodes 35*a*, 35*b* are set at a potential different from those of the common electrodes 34*a*, 34*b* for applying an electric field to the piezoelectric sheets 41 to 43 in the polarizing direction thereof, a portion applied with the electric field works as an active layer, and elongated or contracted in the thickness direction or the lamination direction. As a result, the active layer is to be contracted or elongated in the direction orthogonal to the lamination direction or a face direction thereof by the transversal piezoelectric effect. On the other hand, the remaining two piezoelectric sheets 44, 45 are inactive layers which are not provided with regions sandwiched between the individual electrodes 35*a*, 35*b* and the common electrodes 34*a*, 34*b* and therefore, they do not contract in themselves. That is, the actuator unit 21 has a so-called unimorph structure in which the upper (i.e., distant from the pressure chamber 10) three piezoelectric sheets 41 to 43 are layers wherein active layers are present, and the lower (i.e., near the pressure chamber 10) two piezoelectric sheets 44 and 45 are made into inactive layers.

Therefore, when the individual electrodes 35*a*, 35*b* are set at a positive or negative predetermined potential such that the electric field is in the same direction as the polarization, by controlling the driver IC 132, the corresponding active layers of the piezoelectric sheets 41 to 43 sandwiched between the individual electrodes 35*a*, 35*b* and the common electrodes 34*a*, 34*b* are contracted in the face direction. On the other hand, the piezoelectric sheets 44, 45 do not contract in themselves. At this time, as illustrated in FIG. 9A, the lowermost face of the piezoelectric sheets 41 to 45 is fixed to the upper face of the partition partitioning pressure chambers, as a result, the piezoelectric sheets 41 to 45 deform into a convex shape toward the pressure chamber side based on the transversal piezoelectric effect. Therefore, the volume of the pressure chamber 10 is decreased to raise the pressure of ink. The ink is thereby ejected through the ink ejection port 8. After this, when the individual electrodes 35*a* and 35*b* are returned to the same potential as that of the common electrodes 34*a* and 34*b*, the piezoelectric sheets 41 to 45 return to the original shape and the pressure chamber 10 also returns to its original volume. Thus, the pressure chamber 10 draws ink therein through the manifold channel 5.

In another driving method, all the individual electrodes 35*a* and 35*b* are set in advance at a different potential from that of the common electrodes 34*a* and 34*b*. When an ejecting request is issued, the corresponding pair of individual electrodes 35*a* and 35*b* is once set at the same potential as that of the common electrodes 34*a* and 34*b*. After this, at a predetermined timing, the pair of individual electrodes 35*a* and 35*b* is again set at the different potential from that of the common electrodes 34*a* and 34*b*. In this case, at the timing when the pair of individual electrodes 35*a* and 35*b* is set at the same potential as that of the common electrodes 34*a* and 34*b*, the piezoelectric sheets 41 to 45 return to their original shapes. The corresponding pressure chamber 10 is thereby increased in volume from its initial state (the state that the potentials of both electrodes differ from each other), to draw ink from the manifold channel 5 into the pressure chamber 10. After this, at the timing when the pair of individual electrodes 35*a* and 35*b* is again set at the different potential from that of the common electrodes 34*a* and 34*b*, the piezoelectric sheets 41 to 45 deform into a convex shape toward the pressure chamber 10. The volume of the pressure chamber 10 is thereby decreased and the pressure of ink in the pressure chamber 10 increases to eject ink.

On the other hand, in case that the polarization occurs in the reverse direction to the electric field applied to the piezoelectric sheets 41 to 43, the active layers in the piezoelectric sheets 41 to 43 sandwiched by the individual electrodes 35*a* and 35*b* and the common electrodes 34*a* and 34*b* are ready to elongate perpendicularly to the polarization by the transversal piezoelectric effect. As a result, the piezoelectric sheets 41 to 45 deform into a concave shape toward the pressure chamber 10. Therefore, the volume of the pressure chamber 10 is increased to draw ink from the manifold channel 5. After this, when the individual electrodes 35*a* and 35*b* return to their original potential, the piezoelectric sheets 41 to 45 also return to their original flat shape. The pressure chamber 10 thereby returns to its original volume to eject ink through the ink ejection port 8.

Further, according to this embodiment, as described above, it is known that the base block 75 is disposed at inside of the groove portion 73*b* of the holder main body 73, and the holder main body 73 includes a skirt-like portion (skirt portion) to cover the base block 75. Here, the skirt portion of the holder main body 73 functions as a reinforcing member for increasing the strength of the support member 71. Further, FPC 50 is fixed by the seal member 85 between the skirt portion of the holder 73 and the passage unit 4. Therefore, bending the head can be prevented. Application of stresses to the portion of connecting the actuator unit 21 and FPC 50 can be prevented and FPC 50 can be held securely.

As described above, according to the ink-jet head 1 of this embodiment, the FPC 50 having the conductor portion 53 and 54 electrically connected to the actuator unit 21, is fixed to a portion at a vicinity of the end portion of the passage unit 4 and the holder 72 forming a portion of the support member 71 by the seal member 85. Therefore, even when a force of peeling off FPC 50 from the actuator unit 21 is exerted from outside, a large force is restrained from directly exerting to the portion of connecting the actuator unit 21 and FPC 50. Therefore, the FPC 50 is difficult to peel off from the actuator unit 21 and therefore, the electric connection between the actuator unit 21 and the driver IC 80 can be reliably maintained. Further, the holder 72 forming a portion of the support member 71 can reduce stresses applied to the portion connecting the actuator 21 and FPC 50 (for peeling off the both members) by bending the whole span of the head. Further, ink can be prevented from entering the portion of connecting the actuator unit 21 and the FPC 50 from outside. This prevents the portions connecting both members from electric shortcircuit. As a result, the electric connection of the ink-jet printer 301 can be reliably maintained.

Further, the conductive portions 53 and 54 are included in FPC 50 and therefore, even when the force for peeling off the conductive portions 53 and 54 from the actuator unit 21 is exerted from outside, the force is further dispersed. Therefore, the conductive portions 53 and 54 are more difficult to peel off from the actuator unit 21. Therefore, the electric connection between the actuator unit 21 and the driver IC 80 can be further reliably maintained.

Further, the support member 71 includes the base block 75 formed with the ink reservoir 3 constituting the passage of ink supplied to the passage unit 4. Therefore, even when the head is elongated relative to the passage unit 4 consuming ink, ink can reliably be supplied and the construction is simplified as a whole. Further, because the base block 75 is disposed with the partition wall 75*a*, the partition wall 75*a* functions as a light structure for reinforcing the support and contributes to increase the strength of the ink-jet heat 1.

Further, because the predetermined clearance is formed between the base block 75 and the actuator unit 21, the operation of the actuator unit 21 (deformation of piezoelectric sheets 41 through 45) is not negatively affected and a force can be restrained from directly exerting to the portion of connecting the actuator unit 21 and FPC 50 from outside.

Further, according to the ink-jet head 1, at the both end portions in the sub scanning direction of the nozzle plate 30 arranged at the lowermost layer of the passage unit 4, the projected portions 30*a* provided along the longitudinal direction are bent closer to the holder 72. Therefore, even when the front end portion of the image recording medium collides with the projected portions 30*a*, the front end portion is advanced to the position opposed to the head 1 while being guided. This can prevent the front end portion of the image recording medium from colliding with the side face of the head 1, which may cause the image recording medium to jam and may fail the head 1. Further, in order to restrain the front end portion of sheet from colliding with the side face of the head 1, the nozzle plate 30 is utilized. Therefore, it is not necessary to prepare other member, which reduces cost with minimal increase in head size. Thus, an ink-jet printer having improved image recording medium jam prevention capability and being fabricated at a low cost can be provided.

Further, the FPC 50 fixed on the upper face of each actuator unit 21 and extended is closer to the holder 72. Here, the folded upper end portion of the projected portions 30*a* of the nozzle plate 30 is located at a position beyond the connecting part between the actuator unit 21 and FPC 50. Therefore, at the folded nozzle plate 30, the force which occurs when the sheet collides can be prevented from exerting directly on the FPC 50. As the result, the electric connection between the actuator unit 21 and FPC 50 can be reliably maintained.

Further, because only the projected portions 30*a* provided at the nozzle plate 30 may be bent, and not the total of a vicinity of the end portion of the nozzle plate 30, the fabrication process is improved.

Further, because the projected portions 30*a* are provided at the positions in correspondence with the vicinities of both end portions and the middle portions of an image recording medium, or at the positions in correspondence with the vicinities of the both end portions and the positions substantially uniformly dividing the interval of the image recording medium, the front end portion of the image recording medium is more easily advanced to the position opposed to the head 1. Therefore, the flow of the image recording medium improves.

Figure 13:
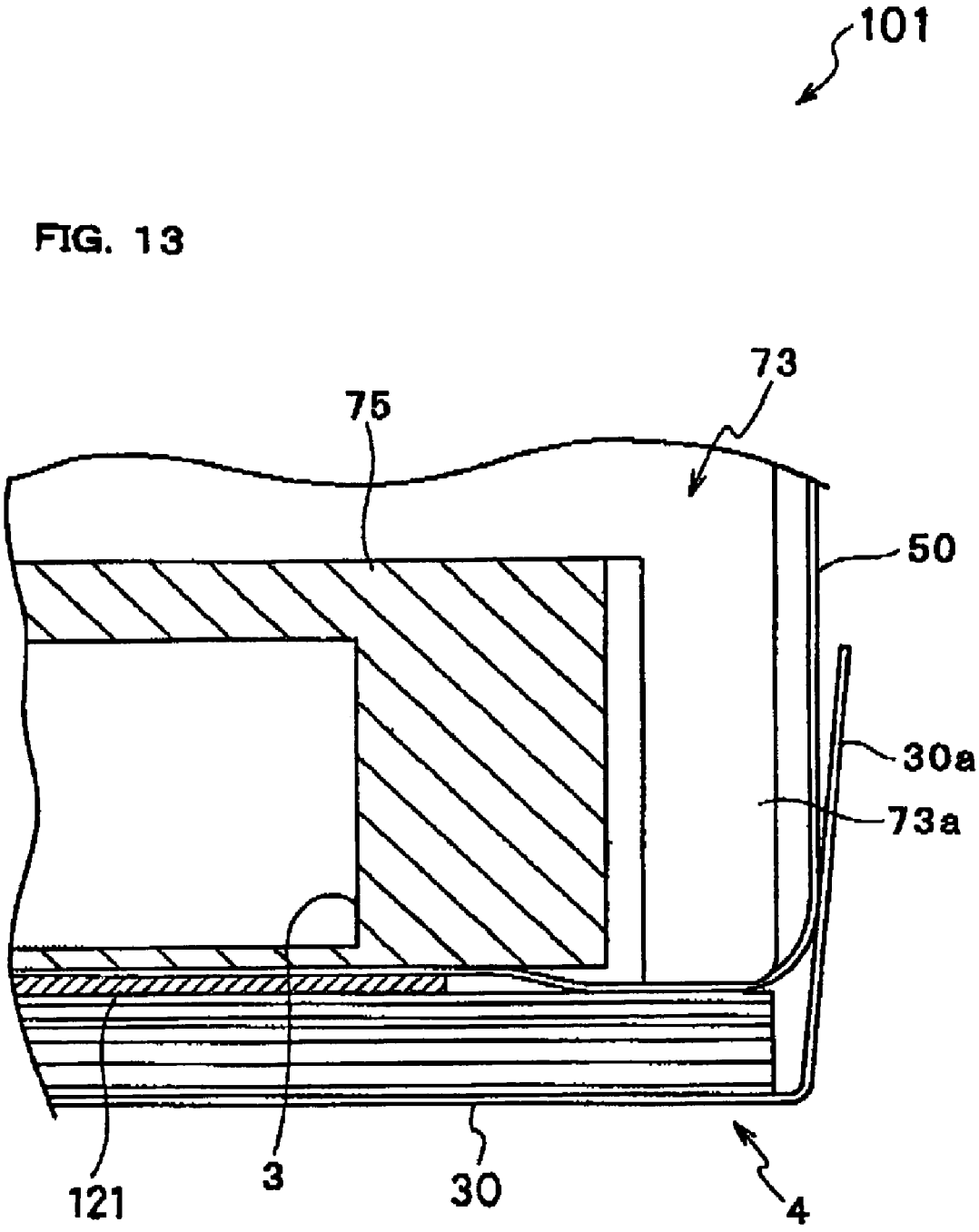
FIG. 13 is an enlarged sectional view of a vicinity of an end portion of a head unit of an ink-jet head according to a first modified example of the embodiment of the invention.

Next, a first modified example of this embodiment of invention will be explained in reference to the drawings. FIG. 13 is an enlarged sectional view of a vicinity of an end portion of a head unit of an ink-jet head according to a first modified example of the embodiment of the invention. A point that the ink-jet head 101 of FIG. 13 differs from the ink-jet head 1 of FIG. 12, resides in that whereas in the case of the ink-jet head 1 of FIG. 12, FPC 50 is fixed to the passage unit 4 and the holder main body 73 by the seal member 85 disposed between the upper face of the passage unit 4 and the lower face of the projected portion 73*a* of the holder main body 73, according to the ink-jet head 101 of FIG. 13, between the upper face of the passage unit 4 and the lower face of the projected portion 73*a* of the holder main body 73, FPC 50 is interposed by the both members. Further, other constitutions are the same as those of the ink-jet head 1 of FIG. 12 and therefore, the same notations are attached and a description thereof will be omitted.

Here, according to the ink-jet head 101 of the first modified example, an FPC 50 electrically connected to the actuator unit 121 is interposed by the projected portion 73*a* of the holder main body 73 and the passage unit 4. Therefore, even when a force of peeling off the FPC 50 from the actuator unit 121 is exerted from outside, a large force can be restrained from directly exerting to the portion of connecting the actuator unit 121 and the FPC 50. Therefore, the FPC 50 is difficult to peel off from the actuator unit 121 and thus, the electric connection between the actuator unit 121 and the driver IC can be reliably maintained.

In this case, similar to the ink-jet head 1 of FIG. 12, the seal member 85 may be disposed to a portion interposed by the projected portion 73*a* of the holder 73 and the passage unit 4. Thereby, conductive ink can be prevented from entering the portion connecting the actuator unit 121 and FPC 50 via the interposed portion.

Figure 14:
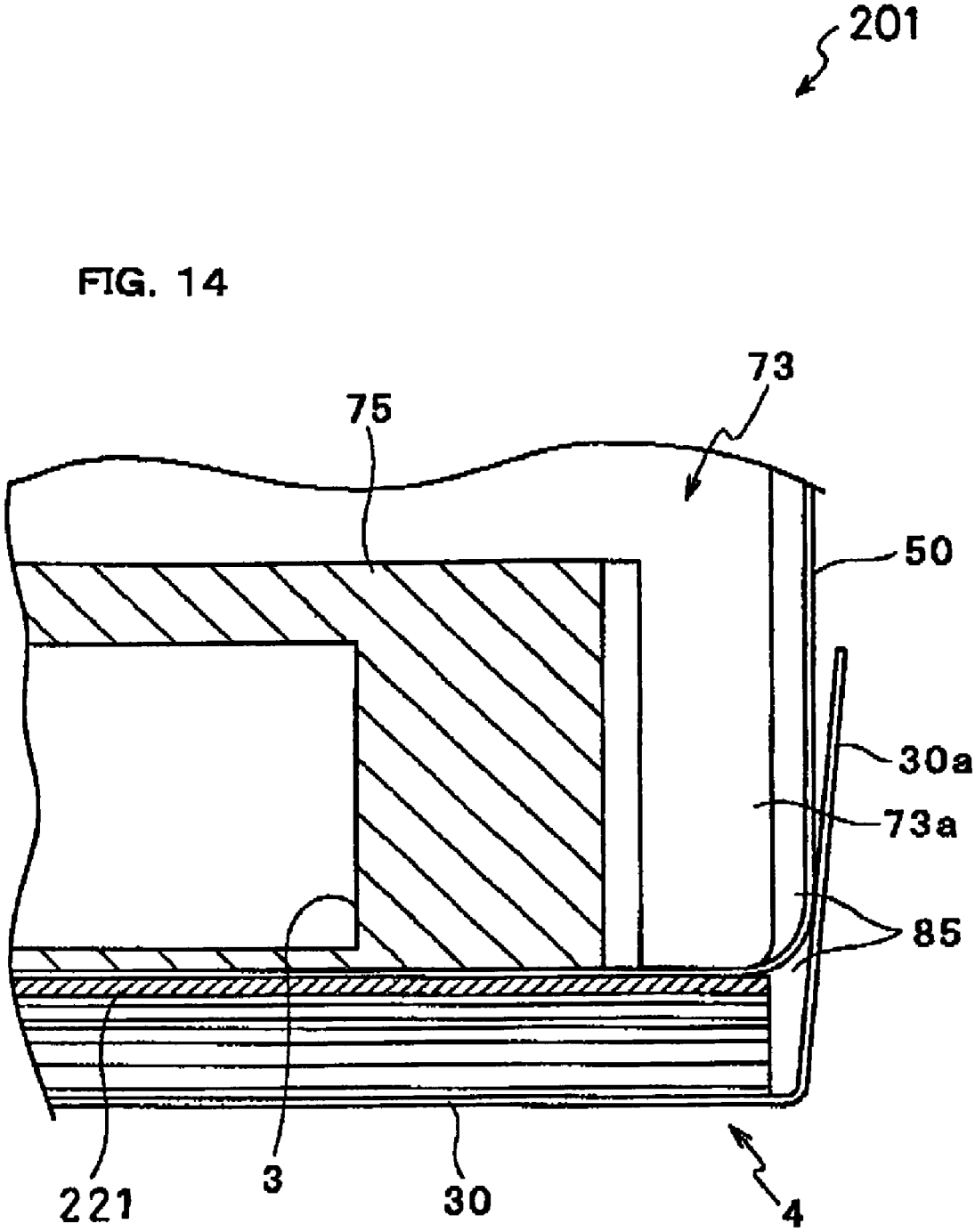
FIG. 14 is an enlarged sectional view of a vicinity of an end portion of a head unit of an ink-jet head according to a second modified example of the embodiment of the invention.

Next, a second modified example of this embodiment of invention will be described in reference to the drawings. FIG. 14 is an enlarged sectional view of a vicinity of an end portion of a head unit of an ink-jet head according to a second modified exemplary embodiment of the invention. In the ink-jet head 201 of FIG. 14, unlike the ink-jet head 1 of FIG. 12, the FPC 50 is interposed between an upper face end portion of the actuator unit 21 and the lower face of the projected portion 73*a* of the holder main body 73. However, other constitutions are the same as those of the ink-jet head 1 of FIG. 12 and therefore, the same notations are attached and a description thereof will be omitted.

Here, according to the ink-jet head of the second modified example, an actuator unit 221 is provided on the upper face of the passage unit 4 up to a vicinity of an end portion thereof. An FPC 50 electrically connected to the actuator unit 221 is interposed by the projected portion 73*a* of the holder main body 73 and the actuator unit 221. Therefore, even when a force of peeling off FPC 50 from the actuator unit 221 is exerted from outside, a large force is restrained from directly exerting to the portion of connecting the actuator unit 221 and FPC 50. Therefore, FPC 50 is a difficult to peel off the actuator unit 221. Thus, the electric connection between the actuator unit 221 and the driver IC 80 can be reliably maintained. Further, by arranging the seal member 85 at the interposed portion according to the modified example, the above-described advantage can be more easily realized.

For example, according to the above-described embodiment, a description has been given of a case in which the conductor portion 53 constituting a wiring for connecting the connection pad 55 connected to the individual electrode 35*a* and the driver IC 80 and the conductor portion 54 constituting a wiring for grounding the connection pad 60 are included in FPC 50, the invention is not limited thereto but at least one of the wiring for connecting the connection pad and the driver IC and the wiring for grounding the connection pad may be arranged as a single signal line. Here, particularly, when the conductor portions 53 constituting the wirings for connecting the connection pads 55 connected to the individual electrodes 35*a* occupying a large number of the conductor portions and the driver IC 80 are formed on FPC 50, an effect similar to that of the embodiment can be achieved.

Further, while the above-described embodiment discloses a base block 75 formed with the ink reservoir 3 constituting the passage of ink supplied to the passage unit 4, the support member may not necessarily include the base block formed with the ink reservoir.

Further, while the above-described embodiment discloses forming the predetermined clearance between the base block 75 and the actuator unit 21, forming the clearance between the both members but the both members may is not required. Thus, both members may be arranged to be brought into contact with each other.

Further, while the above-described embodiment discloses grounding the common electrodes 34*a* and 34*b*, the invention is not limited to such arrangements. A drive signal different from a drive signal supplied to the individual electrode may be supplied to the common electrode within a range in which operation similar to that of the embodiment can be carried out with respect to the actuator unit.

Further, while the above-described embodiment discloses bending only 6 of the projected portions 30*a* provided at each of the both end portions in the sub scanning direction of the nozzle plate 30 to be spaced apart from each other by predetermined intervals, the invention is not limited to such arrangements. The nozzle plate may not have to be provided with the projected portions and a total of a vicinity of the end portion of the nozzle plate may be bent. Further, even when the projected portions are provided, the number and arrangement thereof can arbitrarily be changed. Therefore, by forming a central portion in the longitudinal direction by position X constituting a reference position, the projected portions may be arranged to be spaced apart from each other by a distance in correspondence with a half of a sheet width for a standard size, it is not required to provide the projected portions in correspondence with a sheet width for a standard size as in the embodiment but a plurality of the projected portions may be arranged at uniform intervals. Further, according to the nozzle plate 30, it is required that the portions be bent to project to the sub scanning direction, and the projected portions are present at both of the both end portions in the sub scanning direction but may be provided at least on the upstream side in the sub scanning direction of the nozzle plate.

The materials of each piezoelectric sheet and each electrode used in the above-described embodiments are not limited to the above-described materials. They can be changed to other known materials. The shapes in plan and sectional views of each pressure chamber, the arrangement of pressure chambers, the number of piezoelectric sheets including active layers, the number of inactive layers, etc., can be properly changed. The thickness of the piezoelectric sheets including the active layer and the thickness of the piezoelectric sheets which do not include the active layer may be the same or different from each other. Finally, although any inactive layer is made of a piezoelectric sheet in the above-described embodiment, the inactive layer may be made of an insulating sheet other than a piezoelectric sheet.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head comprising:

a head unit including a passage unit in which a plurality of pressure chambers, each having one end connected with a nozzle for ejecting ink and the other end to be connected with an ink supply source for supplying ink, are arranged along a plane to neighbor each other, and an actuator unit arranged at a surface of the passage unit for changing the volume of each of the pressure chambers, the actuator including individual electrodes;

signal lines electrically connected to the individual electrodes of the actuator unit, each signal line supplying a drive signal to each of the individual electrodes so as to change the volume of each of the pressure chambers; and a support member for supporting the head unit, wherein the signal lines are contiguously interposed and pressed between the support member and either one of the passage unit and the actuator unit at a position remote from connection parts of the signal lines to the individual electrodes in a direction toward which the signal lines are extended to an outside of a space between the support member and either one of the passage unit and the actuator unit.

2. The ink-jet head according to claim 1, further comprising a flexible cable formed with the signal lines as a conductive pattern electrically connected to the individual electrodes.

3. The ink-jet head according to claim 2, wherein the actuator unit includes a common electrode supplied with a drive signal different from the drive signals supplied to the individual electrodes; and wherein the flexible cable is further formed with a conductive pattern electrically connected to the common electrode.

4. The ink-jet head according to claim 1, wherein the support member includes an ink supply member for supplying ink to the passage unit.

5. The ink-jet head according to claim 4, wherein a predetermined clearance is formed between the ink supply member and the actuator unit.

6. An ink-jet head comprising:

a head unit including a passage unit in which a plurality of pressure chambers, each having one end connected with a nozzle for ejecting ink and the other end to be connected with an ink supply source for supplying ink, are arranged along a plane to neighbor each other, and an actuator unit arranged at a surface of the passage unit for changing the volume of each of the pressure chambers;

signal lines electrically connected to the actuator unit, each signal line supplying a drive signal for changing the volume of each of the pressure chambers;

a support member for supporting the head unit; and a seal member arranged between the support member and either one of the passage unit and the actuator unit, the seal member remote from a connecting part between the actuator unit and the signal lines, wherein the seal member directly fixes the signal lines to the support member and either one of the passage unit and the actuator unit remote from the connecting part between the actuator unit and the signal lines.

7. The ink-jet head according to claim 6, wherein the actuator unit includes individual electrodes, each individual electrode being supplied with the drive signal, the ink-jet head further comprising:

a flexible cable formed with the signal lines as a conductive pattern electrically connected to the individual electrodes.

8. The ink-jet head according to claim 7, wherein the actuator unit includes a common electrode supplied with a drive signal different from the drive signals supplied to the individual electrodes; and wherein the flexible cable is further formed with a conductive pattern electrically connected to the common electrode.

9. The ink-jet head according to claim 6, wherein the support member includes an ink supply member for supplying ink to the passage unit.

10. The ink-jet head according to claim 9, wherein a predetermined clearance is formed between the ink supply member and the actuator unit.

11. An ink-jet head comprising:

a head unit including a passage unit in which a plurality of pressure chambers, each having one end connected with a nozzle for ejecting ink and the other end to be connected with an ink supply source for supplying ink, are arranged along a plane to neighbor each other, the passage unit including a plurality of laminated plates, and an actuator unit arranged at a surface of the passage unit to be remote from an end portion of the passage unit for changing the volume of each of the pressure chambers;

a flexible cable electrically connected to the actuator unit and formed with signal lines as a conductive pattern, each signal line supplying a drive signal for changing the volume of the pressure chamber;

a support member for supporting the head unit, the support member having the ink supply member and a holder for fixing the ink supply member; and a seal member arranged between the holder and the passage unit, remote from a connecting part between the actuator unit and the flexible cable, wherein the seal member directly fixes the flexible cable to the passage unit and the holder remote from the connecting part between the actuator unit and the flexible cable.

12. The ink-jet head according to claim 11, wherein a predetermined clearance is formed between the ink supply member and the actuator unit.

13. An ink-jet head comprising:

a head unit including a passage unit in which a plurality of pressure chambers, each having one end connected with a nozzle for ejecting ink and the other end to be connected with an ink supply source for supplying ink, are arranged along a plane to neighbor each other, the passage unit including a plurality of laminated plates, and an actuator unit arranged at a surface of the passage unit for changing the volume of each of the pressure chambers;

a holder for supporting the passage unit, the holder arranged over a face of the actuator unit opposite to the surface; and a flexible cable electrically connected to the actuator unit and formed with signal lines as a conductive pattern, each signal line supplying a drive signal for changing the volume of the pressure chamber;

wherein the vicinity of an end portion of a nozzle plate including the nozzle along the longitudinal direction thereof is folded to bend to get closer to the holder and the folded end portion of the nozzle plate along the longitudinal direction thereof is located at a position beyond the connecting part between the actuator unit and the flexible cable.

14. The ink-jet head according to claim 13, wherein the nozzle plate is provided with a plurality of projected portions along the longitudinal direction thereof and the projected portions are folded to bend to get closer to the holder.

15. The ink-jet head according to claim 14, wherein the projected portions are provided at a first position, a second position at which a distance from the first position is in correspondence with a sheet width for a standard size, and a third position between the first position and the second position.

16. The ink-jet head according the claim 13, wherein the bent nozzle plate forms a rounded portion.

17. An ink-jet printer including an ink-jet head comprising:

a head unit including a passage unit in which a plurality of pressure chambers, each having one end connected with a nozzle for ejecting ink and the other end to be connected with an ink supply source for supplying ink, are arranged along a plane to neighbor each other, and an actuator unit arranged at a surface of the passage unit for changing the volume of each of the pressure chambers, the actuator unit including individual electrodes;

signal lines electrically connected to the individual electrodes of the actuator unit, each signal line supplying a drive signal to each of the individual electrodes so as to change the volume of each of pressure chambers; and a support member for supporting the head unit, wherein the signal lines are contiguously interposed and pressed between the support member and either one of the passage unit and the actuator unit at a position remote from connection parts of the signal lines to the individual electrodes in a direction toward which the signal lines are extended to an outside of a space between the support member and either one of the passage unit and the actuator unit.

18. An ink-jet printer including an ink-jet head comprising:

a head unit including a passage unit in which a plurality of pressure chambers, each having one end connected with a nozzle for ejecting ink and the other end to be connected with an ink supply source for supplying ink, are arranged along a plane to neighbor each other, and an actuator unit arranged at a surface of the passage unit for changing the volume of each of the pressure chambers;

signal lines electrically connected to the actuator unit, each signal line supplying a drive signal for changing the volume of the pressure chambers;

a support member for supporting the head unit; and a seal member arranged between the support member and either one of the passage unit and the actuator unit, the seal member remote from a connecting part between the actuator and the signal lines, wherein the seal member directly fixes the signal lines to the support member and either one of the passage unit and the actuator unit remote from a connecting part between the actuator unit and the signal lines.

19. An ink-jet printer including an ink-jet head comprising:

a head unit including a passage unit in which a plurality of pressure chambers, each having one end connected with a nozzle for ejecting ink and the other end to be connected with an ink supply source for supplying ink, are arranged along a plane to neighbor each other, the passage unit including a plurality of laminated plates, and an actuator unit arranged at a surface of the passage unit for changing the volume of each of the pressure chambers;

a holder for supporting the passage unit, the holder arranged over a face of the actuator unit opposite to the surface; and a flexible cable electrically connected to the actuator unit and formed with signal lines as a conductive pattern, each signal line supplying a drive signal for changing the volume of the pressure chamber.

wherein the vicinity of an end portion of a nozzle plate including the nozzle along the longitudinal direction thereof is folded to bend to get closer to the holder and the folded end portion of the nozzle plate along the longitudinal direction thereof is located at a position beyond the connecting part between the actuator unit and the flexible cable.

* * * * *